US009534400B2

(12) United States Patent
Schacht et al.

(10) Patent No.: US 9,534,400 B2
(45) Date of Patent: Jan. 3, 2017

(54) FLOOR ELEMENT, LOCKING SYSTEM FOR FLOOR ELEMENTS, FLOOR COVERING AND METHOD FOR COMPOSING SUCH FLOOR ELEMENTS TO A FLOOR COVERING

(71) Applicant: FLOORING INDUSTRIES LIMITED, SARL, Bertrange (LU)

(72) Inventors: Benny Schacht, Vlamertinge (BE); Luc Vanhastel, Tielt (BE); Mark Cappelle, Staden (BE)

(73) Assignee: FLOORING INDUSTRIES LIMITED, SARL, Betrange (LU)

( * ) Notice: Subject to any disclaimer, the term of this patent is extended or adjusted under 35 U.S.C. 154(b) by 0 days.

(21) Appl. No.: 14/329,157

(22) Filed: Jul. 11, 2014

(65) Prior Publication Data

US 2014/0318070 A1 Oct. 30, 2014

Related U.S. Application Data

(63) Continuation of application No. 12/519,456, filed as application No. PCT/IB2007/004153 on Dec. 17, 2007, now Pat. No. 8,806,830.

(30) Foreign Application Priority Data

Dec. 21, 2006 (BE) ..... 2006/0641
Sep. 18, 2007 (DE) ..... 20 2007 013 059 U

(51) Int. Cl.
*E04F 15/14* (2006.01)
*E04F 15/02* (2006.01)
(Continued)

(52) U.S. Cl.
CPC ..... *E04F 15/02038* (2013.01); *E04F 15/02* (2013.01); *E04F 15/022* (2013.01);
(Continued)

(58) Field of Classification Search
CPC ..... E04F 15/10; E04F 15/107; E04F 15/02; E04F 15/02005; E04F 15/02038; E04F 2201/03; E04F 2201/04; E04F 2201/041; E04F 2201/042; E04F 2201/043; E04F 2201/044; E04F 2201/045; E04F 2201/046
(Continued)

(56) References Cited

U.S. PATENT DOCUMENTS 3,579,941 A 5/1971 Tibbals
3,691,140 A 9/1972 Silver
(Continued)

FOREIGN PATENT DOCUMENTS

DE 29 40 945 A1 4/1981
DE 297 10 175 U1 9/1997
(Continued)

OTHER PUBLICATIONS

International Search Report from corresponding PCT Application No. PCT/IB2007/004153, Jul. 17, 2008.

*Primary Examiner* — William Gilbert
(74) *Attorney, Agent, or Firm* — Workman Nydegger

(57) ABSTRACT

Floor element of the type which, at least at two opposite edges, comprises coupling means enabling two of such floor elements to cooperate with each other at the respective edges, wherein the floor element comprises at least two components, as well as entity-forming means, which, starting from the aforementioned components, can form an entity including the components, wherein said components can adopt at least two mutual positions, whether or not by means of the disruption of the entity formed by said entity-forming means.

22 Claims, 20 Drawing Sheets

(51) Int. Cl.

| | |
|---|---|
| ***E04F 15/022*** | (2006.01) |
| ***E04F 15/04*** | (2006.01) |
| ***E04F 15/08*** | (2006.01) |
| ***E04F 15/10*** | (2006.01) |

(52) U.S. Cl.

CPC .. *E04F 15/02033* (2013.01); *E04F 15/02194* (2013.01); *E04F 15/04* (2013.01); *E04F 15/041* (2013.01); *E04F 15/042* (2013.01); *E04F 15/043* (2013.01); *E04F 15/048* (2013.01); *E04F 15/082* (2013.01); *E04F 15/085* (2013.01); *E04F 15/087* (2013.01); *E04F 15/102* (2013.01); *E04F 15/105* (2013.01); *E04F 15/107* (2013.01); *E04F 2201/0115* (2013.01); *E04F 2201/0123* (2013.01); *E04F 2201/0138* (2013.01); *E04F 2201/0153* (2013.01); *E04F 2201/05* (2013.01); *E04F 2201/0523* (2013.01); *Y10T 428/167* (2015.01)

(58) Field of Classification Search

USPC ..... 52/380, 392, 533, 534, 539, 553, 578, 52/582.1, 586.1, 586.2, 588.1, 589.1, 52/590.2, 590.3, 591.1, 591.2, 591.63, 52/571.4, 591.5, 592.1, 592.2, 592.4, 52/745.08, 745.49, 747, 747.11, 748.1

See application file for complete search history.

(56) References Cited

U.S. PATENT DOCUMENTS

| | | | | |
|---|---|---|---|---|
| 4,953,335 | A | 9/1990 | Kawaguchi et al. | |
| 5,671,575 | A | 9/1997 | Wu | |
| 6,134,854 | A | 10/2000 | Stanchfield | |
| 6,854,235 | B2 * | 2/2005 | Martensson | 52/601 |
| 7,131,242 | B2 * | 11/2006 | Martensson et al. | 52/591.3 |
| 2005/0076598 | A1 * | 4/2005 | Lewark | 52/591.4 |

FOREIGN PATENT DOCUMENTS

| | | | | |
|---|---|---|---|---|
| DE | 102 04 991 | C1 | | 10/2003 |
| DE | 203 10 959 | U1 | | 10/2003 |
| EP | 1 103 672 | A2 | | 5/2001 |
| EP | 1 251 219 | A1 | | 10/2002 |
| EP | 1 437 456 | A1 | | 7/2004 |
| EP | 1 282 752 | B1 | | 10/2004 |
| EP | 1 589 160 | A2 | | 10/2005 |
| GB | 2 085 357 | A | | 4/1982 |
| GB | 2256023 | A | | 11/1992 |
| JP | 7-76923 | A | | 3/1995 |
| JP | 7-300979 | | * | 11/1995 |
| WO | 93/01378 | A1 | | 1/1993 |
| WO | 94/26999 | A1 | | 11/1994 |
| WO | 97/47834 | A1 | | 12/1997 |
| WO | 99/01629 | A1 | | 1/1999 |
| WO | 00/47841 | A1 | | 8/2000 |
| WO | 01/02671 | A1 | | 1/2001 |
| WO | 01/96688 | A1 | | 12/2001 |
| WO | 01/96689 | A1 | | 12/2001 |
| WO | 01/98603 | A2 | | 12/2001 |
| WO | 2004/063491 | A1 | | 7/2004 |
| WO | 2005/061191 | A1 | | 7/2005 |
| WO | 2005/098163 | A1 | | 10/2005 |
| WO | 2006/058548 | A1 | | 6/2006 |
| WO | 2006/066776 | A2 | | 6/2006 |
| WO | 2006/125646 | A1 | | 11/2006 |

* cited by examiner

FLOOR ELEMENT, LOCKING SYSTEM FOR FLOOR ELEMENTS, FLOOR COVERING AND METHOD FOR COMPOSING SUCH FLOOR ELEMENTS TO A FLOOR COVERING

BACKGROUND OF THE INVENTION

1. Field of the Invention

This invention relates to floor elements, as well as to floor coverings which are composed of such floor elements, and to a method for composing such floor elements to a floor covering. The invention also relates to locking systems which can be applied in the aforementioned floor elements.

2. Related Art

More particularly, the invention relates to floor elements, which are intended for forming a floating floor covering and which, during installation, can be coupled at their edges by means of mechanical coupling parts, the latter either being made in one piece with the floor element or not. Such coupling parts can be made such that they provide for a mutual locking of the floor elements in horizontal as well as in vertical direction, for example, as described in the international patent applications WO 94/26999, WO 97/47834, WO 01/98603 and WO 01/96688.

In order to increase the installation comfort of such floor elements, one mostly strives to implement them with relatively large dimensions. To with, large floor elements are more practical to be applied by the user, and composing a floor covering requires less time when the user can start from large floor elements. In connection with the shorter installation time, also the installation cost of such floor covering is lower. By "large floor elements", substantially floor elements with such a size are meant that they still can easily be handled by a single person. Typical dimensions of such floor elements are, for example, 1200 by 200 millimeters.

However, the fact that smaller floor elements or floor elements with smaller, in particular less wide, decorative parts, in particular when wood parquets or parquet imitations are concerned, are much desired from an esthetically point of view, is contradictory to the aforementioned striving. It is also noted that, although smaller wooden floor elements in respect to material costs per unit of surface area are cheaper than large wooden floor elements, the higher installation costs for smaller floor elements result in that, when the total cost price of the floor covering is brought into account, they will be more expensive than a floor covering composed of large wooden floor elements. Moreover, long, narrow floor elements show the tendency to warp around an axis perpendicular to their decorative side, which leads to problems when installing such floor elements. These problems are very pronounced when the floor elements are installed without glue, i.e., for example, by means of mechanical coupling means, as the aforementioned warping results in difficulties when engaging the coupling means. When installing with glue, when the floor elements are warped, the already installed floor elements have to be strongly tensioned by means of tensioning tools designed especially to this end, which tools as such are known, for example, from WO 99/01629.

In order to offer a solution for the above-mentioned contradictions and problems, rectangular floor elements exist in the state of the art, which as such comprise several decorative portions. Known examples thereof are floor elements which comprise or represent at least two adjacent wooden decorative portions or rows of wooden decorative portions. Depending on the number of such rows, they are called two-planks, three-planks or four-planks. For examples of this solution from the state of the art, reference is made to GB 2 085 357 and WO 93/01378.

The herein above-described rectangular floor elements originating from the state of the art have the disadvantage that it is impossible to compose, starting therefrom, a floor covering with a random bond of decorative parts, as the decorative parts of each time two or more adjacent rows, depending whether a two-plank or a multi-plank, respectively, are concerned, in longitudinal direction of the rows concerned necessarily simultaneously merge into decorative parts of another floor element in the floor covering. The lack of a random bond in such floor covering is seen as disturbing.

The state of the art comprises several suggestions for the improvement of two- or multi-plank elements.

For example, the abovementioned WO 93/01378 suggests matching the decorative parts at the opposing short sides of the rectangular floor elements to each other, such that the motifs of decorative portions, which portions are adjacent to each other, merge into each other where the short sides of two floor elements adjoin each other. It is evident that this technique can only be applied to floor elements with artificially obtained decorative portions, such as decorative portions comprising a printed decor. Moreover, the adaptation of the printed decor in order to obtain such matching is time-consuming and represents a huge restriction of the freedom of design. Also, the lack of a random bond still will be noticeable when, for example, minimal height differences between the different floor elements are present.

In JP 07-076923, EP 1 103 672 and U.S. Pat. No. 4,953,335 is suggested to make the different rows of decorative parts equally long, however, to include them in the floor element at a fixed location in longitudinal direction displaced in relation to each other. The floor elements obtained in this manner are no longer rectangular, but show a pair of stepped opposite sides. However, this suggestion for improving two- or multi-plank elements still has a number of disadvantages. First, the bond which can be obtained by means of such floor elements, still can not relate to a real random bond, as in each case the same step shape would be recognizable in the floor covering, and second, the suggested floor elements, due to their stepped shape, are difficult to package.

SUMMARY OF THE DISCLOSURE

In the first instance, the present invention envisages an alternative and/or improved floor element with which an optionally floating or not floating floor covering can be formed, wherein this floor element simultaneously may result in an increased laying or installation comfort and/or new laying or installation possibilities. Second, the invention, according to several of its preferred embodiments, relates to a floor element which can remedy at least one of the above-mentioned problems, disadvantages or contradictions of the state of the art. To this aim, the invention according to its first aspect relates to a floor element of the type having, at least at two opposite edges, coupling means or coupling parts allowing that two of such floor elements can cooperate with each other at the respective edges, with the characteristic that the floor element comprises at least two components, as well as at least comprises entity-forming means, which, starting from said components, can effect an entity in which said components can adopt at least two mutual positions, whether or not by the disruption of the entity provided by said means. It is clear that a plurality of such floor elements can be applied for forming a floor covering.

As aforementioned, by "entity-forming means", means or portions are meant which allow forming an entity, starting from said components. These are means which are particularly provided for forming such entity, wherein by an entity the smallest possible group of parts is understood, which, as a floor element, can cooperate with equal or similar entities or floor elements, with the intention of forming a floor covering. It is clear that within the scope of the present invention, the respective entities always must comprise two or more of such components. It is also clear that the term entity does not relate to two or more floor panels, which are coupled to each other solely in a manner known as such, for example, from WO 97/47834, or which, more particularly, are coupled solely by means of an identical pair of complementary coupling means present at least at two opposite sides of each floor panel. The entity-forming means of the invention rather relate to provisions which are made separately from the identical pairs of complementary coupling means present at the floor elements and/or at each of the respective components. It is clear that according to the present invention, it is not excluded that, apart from the presence of such identical pairs of complementary coupling means or coupling parts at each component, also a separate entity-forming means is provided at the floor element. For examples of such embodiments, reference is made to the further introduction and the detailed description.

It is noted that the entities or floor elements, which according to the present invention are formed starting from the components, preferably have dimensions which can be handled by a single person in a simple manner. Hereby, this preferably relates to entities with a length that is smaller than two meters, and still better is comprised within the range of 75 centimeters to 150 centimeters, and with a width that is smaller than one meter and still better is within the range of 15 centimeters to 50 centimeters. The floor element preferably has a thickness which is usual for floor panels for parquet or imitation parquet; that is, a thickness between 5 and 25 millimeters.

The particularity of the first aspect of the present invention is situated in the fact that at least two components of a floor element form an entity and still can adopt positions differing in respect to each other. In this way, it is possible to design a floor element, said entity thereof allowing the user to adapt the shape of the floor element, for example, when installing the floor element. Further, it is possible that said components of the floor elements adopt a certain mutual position in the package, for example, a mutual position in which the floor elements can easily be packaged, whereas the user still can readjust or adjust this position before or during the installation of the floor covering. Preferably, said components may adopt a mutual position in which the floor element has a globally rectangular shape. A rectangular or square shape is very beneficial for packaging the floor elements.

It is clear that, the larger the number of different mutual positions of the components, the more installation possibilities with the floor element concerned are offered and the simpler a random bond of decorative parts can be achieved. Therefore, it is also preferred that these mutual positions can be chosen freely and preferably unrestrictedly by the user. This is contrary to an embodiment allowing only a limited number of mutual positions among said components. However, it is noted this last-mentioned embodiment also can have advantages. By limiting the number of possible mutual positions, for example, installation faults can be avoided, or it is possible that one or more installation patterns, such as a herringbone pattern, may already be integrated in the floor elements.

In a preferred embodiment, said components can be shifted in respect to each other. In the case that the components are made as boards, in particular panels or planks, it is preferred that they can be shifted in mutual respect in their length and/or in width direction. Such shifting can be performed in two important manners. On the first hand, such shifting can be performed while the components are situated in the same plane, on the other hand, such shifting can also be performed while the components are angled with their upper sides over a certain angle towards each other. It is also not excluded that the components can be shifted in mutual respect, while they are angled over a certain angle with the undersides towards each other.

Whether boards or planks are concerned, it is preferred that each of said components has a substantially flat side forming a decorative side, and that this decorative side still better is situated at least partially at the upper side of said entity and/or of the floor element. In such case it is clear that the user will be able to change the mutual position of at least the respective decorative sides of said components. This is of particular importance when creating random bonds. Preferably, said components globally have a similar pattern. So, they may have or represent a plank pattern consisting of a certain kind of wood. According to a preferred embodiment, each component has a decorative side, which, viewed in the width of such component, has the appearance of one plank and, viewed in the length, has the appearance of one or more planks. In such case, preferably on one and the same floor element components are combined having a different number of wooden decorative parts, more particularly components which, viewed in the length, have the appearance of a differing number of planks.

It is noted that each of said components preferably at least at a first pair and still better at both pairs of opposite sides is provided with mechanical coupling means, which allow a mutual coupling, wherein preferably at all sides a vertical and horizontal coupling is provided for. However, a combination of coupling means may also be opted for, which provides for a vertical and horizontal locking solely at one pair of opposite sides, whereas at a second pair of sides, preferably at the short sides of oblong components, one works with coupling means allowing either solely a vertical locking, or solely a horizontal locking. It is evident that in the case that solely a vertical locking is desired, one may work with a simple tongue-in-groove connection, and that in the case that solely a horizontal locking is desired, one may work with a so-called "drop" connection, further examples of which will be discussed in the following.

For the sake of the simplicity of the construction and/or of the composing of the floor elements to a floor covering it is recommended to use components having each a decorative side with uniform and equally-sized dimensions. Nevertheless, particular effects may also be achieved when the decorative sides of the components of one and the same floor element, for example, have a different length and/or width.

According to an important embodiment of the present invention, said components have a decorative side with a rectangular oblong shape, wherein said cooperation preferably is such that the decorative sides of said components, at least in said two mutual positions, are positioned with their longitudinal directions next to each other and preferably have a same mutual distance. This means that the resulting displacement from the one mutual position to the other mutual position may be, for example, a mere displacement or shifting of one of the components in its longitudinal direction.

The aforementioned important embodiment may allow, amongst others, to realize an improved floor element of the type two-plank or multi-plank element. Preferably, said decorative sides of said components in such floor element have wooden decorative parts, or respectively one or more rows of wooden decorative parts, which decorative parts or rows then, according to this important embodiment, can adopt a plurality of mutual positions. A user can, at least during the installation of the floor elements, decide on the mutual position which the components of the respective floor element are to adopt in the floor covering, and in this manner can create a composition of the decorative parts thereof himself. It is noted that, when the decorative side of each component shows only a single decorative part or only a single row of decorative parts, a floor element is obtained with which a random bond can be achieved. In other words, in such case this relates to components with a decorative side which, viewed in the width of such component, has the appearance of one plank and, viewed in the length, has the appearance of one or more planks.

In respect to the effected entity, it is noted that it can vary. In the following, a difference is made between two important possible kinds of entity. However, the invention is not restricted to these possibilities or the combinations thereof.

A first possible kind of entity relates to an entity consisting at least of said two mutual positions of the components, or, in other words, said entity-forming means are active at least in said two mutual positions. Preferably, this entity also is maintained during changing from the one mutual position to the other mutual position of the components.

A second possible kind of entity relates to an entity, which is disrupted when changing the one mutual position of the components to the other mutual position. Possibly, herein the entity can be such that a possible disruption thereof is remedied or can be remedied when reaching said second position and/or when returning to said first position. However, it is not excluded that the entity is such that a possible disruption thereof is irrevocable. It is noted that, when a disruption of the entity is mentioned, such disruption preferably can take place without machine-operated tools. However, the use of manual tools, such as a knife, a tapping block, a hammer or the like is not excluded, but it is preferred that such disruption of the entity can take place with bare hands.

The entity-forming means can be made in a plurality of manners, depending whether they must be able to effect an entity of the first and/or of the second kind and/or of another kind. Different possible embodiments are explained in the following.

In a first possible embodiment, said entity-forming means consist at least of mechanical coupling means situated at least at one side of each of said components, wherein these mechanical coupling means allow that the respective sides of said components can cooperate with each other. Such mechanical coupling means or coupling parts preferably are made differently in respect to the mechanical coupling means shown by the floor element as such at two opposite edges thereof. Herein, "differently" is to be interpreted in the broadest sense, however, preferably relates to different dimensions, geometry, material and/or functionality of the coupling means themselves or at least a portion thereof. In respect to the functionality of the coupling means, which form part of the entity-forming means, it is preferred that they can effect at the respective sides a locking in a vertical direction perpendicular to the plane of the floor element and/or in a horizontal direction perpendicular to said sides and in the plane of the floor element. Thus, it is possible that these coupling means are made such that they allow to couple the respective components to each other and/or release them from each other by moving a first of said components at the respective side into one, out of one, respectively, of the other of said components by means of an angling movement around the respective side. It is noted that by means of coupling means, such as described by means of this first possibility, an entity of the first as well as of the second kind can be effected.

In a second possible embodiment, said entity-forming means consist at least of a portion of the floor element, which is situated at the underside of the floor element and which in its turn forms at least one projecting portion, which extends or can extend from a first component of this floor element beneath a second component, wherein preferably the projecting portion covers at least a surface which is approximately equal to the surface of the second component or is larger. Herein, said portion then preferably forms a basic structure. According to a first possibility, this basic structure is made in one piece with the first component or, in other words, forms a part of this component, such that the first component in fact extends or can extend with said projecting portion up to beyond one or more other components. According to a second possibility, this basic structure is made as a separate basic board or basic layer, upon which then the first component is fixedly attached, for example, glued, and this basic board or basic layer projects with said projecting part beyond this first component.

As a material for the basic board or basic layer, for example, wood-based material or synthetic material can be chosen. Thus, the basic structure may comprise, for example, a layer of softwood of the type usually applied with so-called "engineered wood", or may comprise wood fiber material, such as, for example, softboard, MDF or HDF (medium density fiberboard or high density fiberboard). Possibly, the basic structure may also be composed of a plurality of parts or of a plurality of layers, whether or not consisting of different materials.

The basic structure, which is applied according to said second possible embodiment, may also fulfill other functions within the entity of the floor element than solely effect the aforementioned entity. Thus, it can provide, for example, for the dampening of reflection and/or transmitted sound. From this point of view, it is preferred to apply so-called softboard, which comprises pressed wood fibers, and/or cross-linked polyethylene in said basic structure. It is noted that by means of a portion of the floor element, which can be situated or extend at least partially beneath said components, as described by means of this second possibility, an entity of the first as well as of the second kind can be effected. It is noted that such basic structure, in case of narrow components, for example, when at least one of said components has a length-to-width ratio larger than 10, can contribute to a considerable extent to the rigidity of the floor element as a whole and at the same time can offer resistance against the warping of such components, as a result of which it is possible to compose a floor covering by means of such floor elements without any problems.

In a third possible embodiment, said entity-forming means consist at least of a separate attachment means, which can connect at least said components. So, the entity-forming means may consist, for example, at least of an adhesive or glue connection, whether releasable or not, or of a separate mechanical coupling part. By means of the entity-forming means according to this third embodiment, an entity of the third as well as of the second kind can be effected.

It is noted that according to the invention it is not excluded that the entity-forming means are made in another manner than according to the herein-described possibilities and/or that they consist of a combination of the herein-above described possibilities. Such entity -forming means can be provided at any location at the floor element. Thus, they may be provided as well beneath, on or between said components. As an example for an entity-forming means, which is situated on the respective components, reference is made to the possibility to connect the components by providing a, whether or not transparent or translucent, adhering film on their upper side or decorative side, which adhesive connection them of course must allow for that said components can adopt at least the two aforementioned mutual positions. For this application, micro-spherical glues of the type as described in U.S. Pat. No. 3,691,140 can be usefully applied.

For other and/or practical examples of entity-forming means, reference is made to the detailed description.

Apart from the fact whether said means effect an entity of the first, the second or another kind, it is noted that the entity of said components preferably is such, that it is maintained under the influence of solely the own weight of the components, independent from the orientation of the floor element. Still better, it is also maintained when the floor elements undergo normal handling. By "normal handling", amongst others, taking the floor elements out of the package and bringing them to the location of their installation is understood. Further, it is noted that, although this is preferred, according to the invention said components do not necessarily have to be in the package in a mutual position in which said entity is existing. According to another embodiment, said components may even be packaged separately and one can only speak of an entity after the components have been taken from the package and said entity-forming means have been applied by the user for effecting the entity. In the above, it is clear that "maintaining the entity independently from the orientation" means that the floor element allows that it can be held at least to a limited extent out of its normal flat position without destroying said entity. The extent to which said entity is maintained preferably is such that the entity also is maintained during normal handling of the floor element. It is clear that such stable entity enhances the smoothness with which the entities can be installed.

It is clear that the floor elements of the present invention can be constructed in various manners.

For example, this may relate to floor panels, which can be applied for forming solid parquet or an imitation of such parquet. In the first case, this relates to floor elements, of which at least one of said components, and preferably all components, consist of solid real wood, with the exception of a possible wear-resistant top layer, for example, of varnish or lacquer. In the second case, this relates to floor elements of which at least one, and preferably each of said components, has a core and a top layer provided upon the latter. This top layer, or anyhow at least a portion of this top layer, can form a decorative side, which is situated at least partially at the top side of the floor element. The top layer may be a top layer on the basis of synthetic material, which preferably comprises a printed decor with, for example, a wood pattern, as this may be the case with a laminate top layer manufactured by means of a DPL (Direct Pressure Laminate) or HPL (High Pressure Laminate) method. It is known as such to form a DPL top layer by bringing one or more carriers, provided with resin, for example, paper sheets, together with a core material into a press and forming said laminate top layer by means of heat and pressure directly on the core material. For a HPL top layer, one starts from an already earlier formed laminate top layer consisting as such of carriers provided with resin, such as paper sheets, which laminate top layer then is attached to a core material, more particularly glued thereon. Instead of a top layer on the basis of synthetic material, also a top layer on the basis of wood can be applied, wherein preferably the wood structure determines the appearance of said decorative side. Herein, this may relate to a veneer layer or a layer of wood, which is thicker than veneer, for example, thicker than 2 millimeters. For said core on which the top layer is situated, a wood-based material can be chosen, such as, for example, a material on the basis of finely-ground wood, for example MDF or HDF (medium-density fiberboard or high-density fiberboard), or such as an either composed or not composed wood material, for example, solid pinewood or a so-called lamellar core, wherein a core is composed of various laths. For a general example of a floor panel with lamellar core, reference is made to DE 203 10 959 U1.

In an important application for so-called "engineered wood", i.e., floor elements having a top layer of a noble and/or hardwood species, beneath which a layer or structure of a cheaper kind of wood is provided, as known, for example, from said EP 1 589 160 or DE 203 10 959 U1, the components of the floor element of the invention substantially or solely are made of the noble and/or hardwood species, whereas the basic structure then is realized at least of the cheaper wood species, wherein this basic structure then possibly is composed in a similar manner as in one of the manners already applied to known embodiments of "engineered wood".

It is clear that the invention is not restricted to floor elements which can be applied for forming solid parquet or an imitation thereof. Said printed decor, which is used with laminate top layers, thus can also represent other patterns than a wood pattern. For example, it may represent a stone pattern or a fantasy pattern. Moreover, for said top layer use can also be made of top layers on the basis of a material chosen from the group of textile, carpet, cork, vinyl, ceramics, natural stone, artificial stone and brick-like stone. It is also possible that at least one of said components is constructed of another solid material than wood, as, for example, stone, compact laminate, synthetic material or the like.

For composing the floor elements of the first aspect, use can be made of various possible methods. In the following, a first and a second possibility are described, which each separately relate to independent aspects of the invention. This means that they possibly can also be applied to other floor elements than those of the first aspect.

According to a first possibility, and thus according to a second independent aspect of the invention, this relates to a method for composing floor elements to a floor covering, with the characteristic that one starts from floor elements comprising at least a first and a second component, wherein starting from at least one such first component and one such second component an entity can be effected by means of entity-forming means, and that the method at least comprises the step of effecting such entity and/or of changing such entity, as well as at least the step of bringing said components into their final position in the floor covering. The entity and the entity-forming means can be realized in the same manner as discussed above by means of the first aspect. This first possible method allows, when composing the floor elements, to make optimum use of the presence of the entity-forming means and the entity they may form.

Preferably, the changing, as aforementioned, of an entity at least consists in that this entity is at least temporarily disrupted.

Such method according to this first possibility can be applied, for example, for composing floor elements, the components of which are situated in a mutual starting position, wherein the step of changing an entity then consists at least in that said components are brought out of said mutual starting position. For example, said components can be brought as an entity into the floor covering, after which possibly, before reaching their respective mutual positions, said entity is changed. When the floor elements in said mutual starting position of the components have a rectangular, possibly oblong, entity, a very practical installation method is obtained. The floor elements can also be packaged in this mutual starting position, however, not necessarily.

The method can also be applied for composing a floor covering, wherein said entity-forming means are active in the final positions of said components, in other words, in these final positions effect an entity between a first and a second component. The fact that the entity consists at least in the final position of the components, may result, depending on the applied entity-forming means, in various different advantages in connection with the strength of the obtained floor covering, reduction of reflection or transmitted sound and the like.

Each of said components can be provided with a decorative side, which, in the final position of the respective component in the floor covering, is intended for forming a portion of the floor surface. Preferably, the method in this case comprises at least the step of changing the mutual positions of the respective decorative sides, after the components already have been brought into the plane of the floor covering.

According to a second possibility and, therefore, a third independent aspect of the invention, this relates to a method for composing floor elements to a floor covering, wherein these floor elements do not necessarily comprise entity-forming means in the meaning of the first aspect. To this aim, in this second possible method one starts from a first component and a second component, which are situated in a mutual starting position, wherein each of these components is provided with a decorative side, which, in the final position of the respective component in the floor covering, is intended for forming a part of the floor surface, with the characteristic that the method successively comprises at least the steps of bringing, in said mutual starting position, the first as well as the second component together into the plane of the floor covering, bringing the first and the second component out of the mutual starting position and providing at least said first component as well as at least said second component in their respective final position in the floor covering. Due to the fact that two movable components are brought together into the plane of the floor covering, the installation time required with such method can be restricted. When it is provided for that the floor elements in said mutual starting position of the components have a rectangular, and still better also oblong, shape, the installation time can be even more restricted, as such floor elements usually are very practical in their application.

The aforementioned step of bringing the first and the second component out of their mutual starting position preferably comprises that the second component is provided in the floor covering in a position which is shifted in respect to said first component. Preferably, said first component is brought into its final position in the floor covering before the second component is provided in its final position in this floor covering.

The aforementioned first and second possible methods preferably are applied for forming a floor covering representing rows of decorative parts, wherein this floor covering comprises at least a first row of decorative parts, which is formed by first components, and also comprises at least a second row of decorative parts, which is formed by second components, wherein said first row and said second row are lying laterally, i.e., in width direction of the rows, directly next to each other. It is also possible that each row of decorative parts respectively is composed of only one of said components. In the case of a floor element of the type two-plank element, preferably in each case a row of first components alternates with a row of second components. It is clear that, according to the number of components of the floor element, each time preferably adjacent rows of first, second, third and further components are formed in the floor covering.

It is noted that the aforementioned two or more components may have respective decorative sides with substantially equal dimensions as well as decorative sides with dimensions that differ from each other. For example, one may work with decorative sides of different width and/or different length. In the most preferred embodiment of the invention, however, all components of one and the same floor element have the same length and preferably the same width, too.

It is clear that the first and/or the second possible method can be applied for installing the floor elements with the characteristics of the first aspect and the preferred embodiments thereof. Preferably, the methods are applied for composing floor elements having, at least at two opposite edges, coupling means allowing that two of such floor elements can cooperate with each other at the respective edges. In such case, the method preferably also comprises at least the step of coupling the floor elements at the respective edges.

The first and/or in particular the second possible method also offer significant advantages when the width of the components has a width of less than 10 centimeters. According to the methods, in fact one works with packages of these components that are better to handle and to install. Namely, either use is made of an entity of at least two of these components, or a step is performed consisting in bringing at least two components together into the floor covering.

According to a different variant of said second possibility, the step for bringing the first as well as the second component, in said mutual starting position, together into the plane of the floor covering, can also be replaced by a step in which at least said first component, while as such being connected, in said mutual starting position, to said second component, is connected to a third component already arranged in the floor covering. Such connection of the first and the second component and/or of the first and the third component can be realized in the respective step, whether or not completely. Possibly, a partial connection may be used, for example, when the upper sides of the respective connected components are not yet situated in a common plane, but adopt an inclined position in respect to each other. It is clear that such partial connection in said mutual starting position may also be present between the first and the second component. In the further step of bringing the first and the second component out of the mutual starting position, the connection between the first and the third component then may or may not be completely realized. It is clear that the step of providing the first and the second component in their respective final position in the floor covering then at least means that at least the first and the second component as well as at least the first and the third component are completely connected to each other, for example, at least by angling the first and/or the second component into the plane of the floor covering. Said step of bringing the first and the second component into the final position may also comprise at least a relative shifting movement of the second in respect to the first component, wherein this shifting movement then either is performed in said partially joined condition of these two components or not, more particularly in said inclined position of these two components.

The first and/or the second possible method and/or said differing variant thereof show their advantages in particular when starting from floor elements with two or more components, which are situated in equal positions next to each other and thus define in their starting position a globally rectangular, either oblong or square, whole, after which, by means of the method, a final position is created by bringing one or more of said components in a shifted position in respect to the other components. In particular, it is preferred that one starts from components with decorative sides representing oblong laths or planks, wherein these, in the starting position, extend with their long sides parallel next to each other.

Further, it is clear that the invention also relates to a floor covering, which is composed by means of the floor elements of the first aspect and/or by means of said first or second possible method or differing variant thereof. The invention also relates to a set of two or more components and entity-forming means, which are intended for forming, starting from said components, an entity, and wherein this sets allows to compose a floor element according to the first aspect of the invention or anyhow at least a portion thereof. Further, the invention relates to a component for a floor element, which is intended for forming an entity, together with a second, whether or not similar, component, by the intermediary of entity-forming means. It is clear that such sets and components can lead to the composition of floor elements showing the characteristics of the first aspect, and therefore also can effect the advantages coupled to this aspect.

Further, the invention relates to a locking system, which can be applied in a useful manner with floor elements with the characteristics of the first aspect, however, which is not restricted to such floor elements. To this aim, the invention, according to a fourth independent aspect, relates to a locking system for the lateral mutual coupling of floor elements or components of floor elements, wherein the locking system is of the type, which, when coupling a side of a first floor element to a side of a second floor element, effects a locking of the floor elements in a vertical direction perpendicular to the plane of the floor elements, as well as in a horizontal direction perpendicular to the respective coupled sides, wherein the locking system consists at least of coupling means, which substantially are made as a tongue at said side of the first floor element and as a groove, said groove being bordered by means of a lower lip and an upper lip, at said side of the second floor element, and which also are provided with locking means, wherein said locking means comprise a projecting locking element at one of said lips which border the groove, and a cooperating-therewith locking element at the tongue, with the characteristic that the locking system allows that coupled floor elements at the respective coupled side may adopt at least two mutual orientations, namely, on the one hand, a first mutual orientation, wherein the upper surfaces of the floor elements substantially are situated in the same plane and wherein surfaces of said locking elements have portions coming into mutual contact, which portions extend between a lower and an upper horizontal plane, and, on the other hand, a second mutual orientation, wherein the upper surfaces of these floor elements enclose an angle of less than 180 degrees and said surfaces of the locking elements are free from mutual contact, wherein the portion, which comes into contact in the first mutual orientation, of a first of these surfaces, in the second mutual orientation, extends above said upper horizontal plane, and wherein the floor elements at the respective side in the second mutual orientation still are locked in vertical as well as in horizontal direction. By the fact that the portion, which comes into contact in the first mutual orientation, extends in the second mutual orientation above said upper horizontal plane, it is meant that the surfaces, which formed a contact in said first mutual orientation, are completely turned away from each other or, in other words, are no longer turned towards each other.

The fact that the locking system allows that the floor elements or their components can adopt a mutual orientation, in which the contact at the height of the locking elements is completely eliminated, can provide for that the floor elements in this orientation, while they are still coupled in vertical and horizontal directions, can shift along each other with a minimum resistance. This feature can be usefully applied in many installation methods and surely with said first and/or second possible methods for composing floor elements with the characteristics of the first aspect.

Preferably, the floor elements in said first mutual orientation are coupled free from play. This preferred embodiment results in the particularly useful combination of free-from-play coupling with a connection that simply can be shifted in longitudinal direction.

In the second mutual orientation, however, preferably a clearance is present between the sides of the floor elements coupled by means of the locking system, wherein this clearance allows that the floor elements can move over a limited distance in horizontal direction, and that preferably in said second mutual orientation, said locking in vertical and horizontal direction remains maintained over at least half of, and still better the entire range of the possible movement associated with the clearance. By this preferred embodiment, it is obtained that the simplicity of shifting can be maximized, whereas the risk of uncoupling the connection of the floor elements or their components is minimized.

It is possible that in said first mutual orientation said lip forming the projecting locking element is elastically deformed. Preferably, in this case it is less or not at all deformed in said second mutual orientation; for example, in said second mutual orientation there remains only a plastic deformation of this lip, or, still better, it has entirely or almost entirely returned into the position it had before the coupling of the floor elements to the respective side. When a remaining portion of the bending-out is found in the second mutual orientation, it is best smaller than half of the bending in the first mutual orientation, such that the major part of the bending is elastic.

In the most preferred embodiment, said lip containing the projecting locking element relates to said lower lip. Such locking system may be made, for example, by means of a milling process in a simple manner, wherein the respective sides then are provided with profiled areas, which preferably are made in one piece with the floor panel. Such milling process can be applied even simpler when the lower lip extends up to beyond the upper lip. Of course, the invention is not limited to locking systems with a longer lower lip. The lower lip may be made, for example, also equally long or shorter than the upper lip. In respect to milling processes, reference is also made to WO 97/47834, which, amongst others, relates to the milling of coupling means situated on the edge of floor panels.

The mutual orientations allowed for by the locking system can be adopted by the floor panels in any manner. Preferably, the floor elements can be brought from the first to the second mutual position by means of a relative angling movement around the coupled side.

It is noted that the fact that the locking system allows for two mutual orientations between the floor elements or components, does not mean that the respective floor elements, as soon as the respective orientation is reached, will stay in this orientation by themselves, although this is not excluded. Rather, it is meant that the locking system allows that the user, preferably manually, can bring the coupled floor elements into these two mutual orientations and/or hold them there.

Preferably, the locking system of the second aspect also allows that coupled floor elements, at the respective coupled side, may adopt at least a third mutual orientation, in which the top surfaces of these floor elements enclose an angle that is smaller than the angle which they include in the second mutual orientation, and wherein said locking elements also show contacting surfaces. Still better, the floor elements are coupled in this third mutual orientation free from play. Also in this third mutual orientation it is possible that said lip comprising the projecting locking element is elastically deformed. This preferred embodiment provides for an extra barrier against the uncoupling of the floor elements. Of course it remains possible to uncouple the floor elements, however, it is possible that first a certain resistance has to be overcome to do so.

With the same objective as in the fourth aspect, the invention according to its fifth aspect relates to a locking system for laterally coupling together floor elements or components of floor elements, wherein the locking system is of the type that, when coupling a side of a first floor element to a side of a second floor element, effects a locking of the floor elements in a vertical direction perpendicular to the plane of the floor elements, as well as in a horizontal direction perpendicular to the respective coupled sides, wherein the locking system consists at least of coupling means, which substantially are formed as a tongue on said side of the first floor element and a groove, bordered by means of a lower lip and an upper lip, at said side of the second floor element, and which also are provided with locking means, wherein said locking means comprise a projecting locking element at one of said lips bordering the groove, and a cooperating-therewith locking element at the tongue, and said lip comprising the projecting locking element, in a coupled condition of two floor elements, is elastically deformed, wherein the locking systems allows that two floor elements coupled by means thereof can be uncoupled from each other by means of a relative angling movement around the coupled side, with the characteristic that the locking system is made such that said elastic deformation of the lip comprising the projecting locking element, when uncoupling the floor elements by means of said angling movement, undergoes at least three successive changes, namely, a first change, in which the elastic deformation decreases, a second change, in which the elastic deformation increases, and a third change, in which the elastic deformation again decreases. Preferably, said angling movement relates to a movement wherein the included angle between the upper sides of both floor elements decreases.

The fact that in the first change the elastic deformation decreases in order to afterwards, during a second change, increase again, means that the floor elements at the end of the first change come into a mutual orientation, in which this elastic deformation has a local minimum and they thus are less solidly joined, however, this also means that the risk of uncoupling by further angling out is minimized in that said increase of the elastic deformation during the second change forms a barrier to this. A mutual orientation, in which a local minimum of the elastic deformation exists, opens various new possibilities. So, for example, is it possible to provide for that the floor elements in the mutual orientation in which the local minimum of the elastic deformation is reached, can shift with a minimum resistance along each other, while they still are coupled in vertical and horizontal directions. This feature can be usefully applied in many installation methods and surely in the case of said first or second possible method for composing floor elements.

Said elastic deformation may comprise or relate to, for example, a bending of the respective lip. In such case, it is preferred that during said first change a bending of the respective lip decreases, preferably at least about 50 percent; that during the second change the bending of the respective lip increases and that during the third change the bending of the respective lip decreases again. Said lip comprising the projecting locking element preferably relates to the lower lip.

In a preferred embodiment of the fifth aspect, said elastic deformation and/or the bending of the respective lip decreases during the first and/or the second change, until it is approximately completely or completely relaxed. When at the end of the first change a complete relaxation is obtained, the comfort of shifting both floor elements or components along the coupled sides is maximized.

It is clear that the invention also relates to a floor element of the type having, at least at two opposite sides, coupling means, with as a characteristic that said coupling means allow to form, with the coupling means of a similar floor element, a locking system having the characteristics of the fourth and/or the fifth aspect of the invention.

Further, it is clear that the entity-forming means of the floor elements of the first aspect may at least consist of a locking system with the characteristics of the fourth and/or fifth aspect, by which then preferably said components are coupled. Also, it is possible that said coupling means, which the floor elements of the first aspect have at least at two opposite edges, allow forming a locking system according to the fourth and/or the fifth aspect with the coupling means of a similar floor element. Further, it is possible that said components are coupled to each other by means of a locking system according to the fourth and/or the fifth aspect, whether entity-forming means are concerned or not.

Further, the invention also relates to a locking system which is extremely useful for being applied at least at one pair of opposite sides of the aforementioned components and which still allows a simple installation of the floor elements of the invention at difficult to reach locations, such as under overhanging cabinets or beneath door posts. In the case of oblong, rectangular components, the respective locking system preferably is applied at the short opposite sides of these components, whereas at the long sides of these components preferably a locking system is applied which allows at least a coupling by means of an angling movement. The respective locking system is not only useful in the floor elements of the present invention, but can also be applied more broadly in any floor elements. To this end, the invention, according to a sixth independent aspect thereof, relates to a locking system for laterally coupling together floor elements, components of floor elements, respectively, wherein this locking system substantially consists of a male coupling part and a female coupling part situated at the edges of the floor elements or components to be coupled, wherein said coupling parts are provided with locking means, which, in a coupled condition of a side of a first floor element or component and a side of a second floor element or component, effect a locking of the floor elements or components in a horizontal direction perpendicular to the coupled sides in the plane of the floor elements or components, however, wherein these coupling parts are free of locking means which, during coupling to the respective side, effect a locking in a vertical direction perpendicular to the plane of the floor elements or components, with the characteristic that said coupled condition can be obtained by means of said locking system at choice, either by providing said male coupling part of the first floor element or component with a substantially downward movement in the female coupling part of the second floor element or component, or by moving the first and the second floor element or component with the edges, which are provided with said coupling parts, with a substantially horizontal shifting movement towards each other.

Thus, the sixth aspect of the invention relates to a locking system allowing both a locking by means of a downward movement as well as a locking by means of a substantially horizontal shifting movement of the components, but with which, however, solely a horizontal locking is obtained and no vertical locking of the respective components or floor elements is obtained.

BRIEF DESCRIPTION OF THE DRAWINGS

With the intention of better showing the characteristics of the invention, hereafter, as an example without any limitative character, several preferred embodiments are described, with reference to the accompanying drawings, wherein:

FIGS. 21 to 30 represent locking systems according to the invention, wherein FIGS. 23, 24, 28, 29 and 30 represent views onto the regions respectively indicated in FIG. 21 by F23, in FIG. 22 by F24, in FIG. 25 by F28, in FIG. 26 by F29 and in FIG. 27 by F30;

DETAILED DESCRIPTION OF PREFERRED EMBODIMENTS OF THE INVENTION

Figure 1:
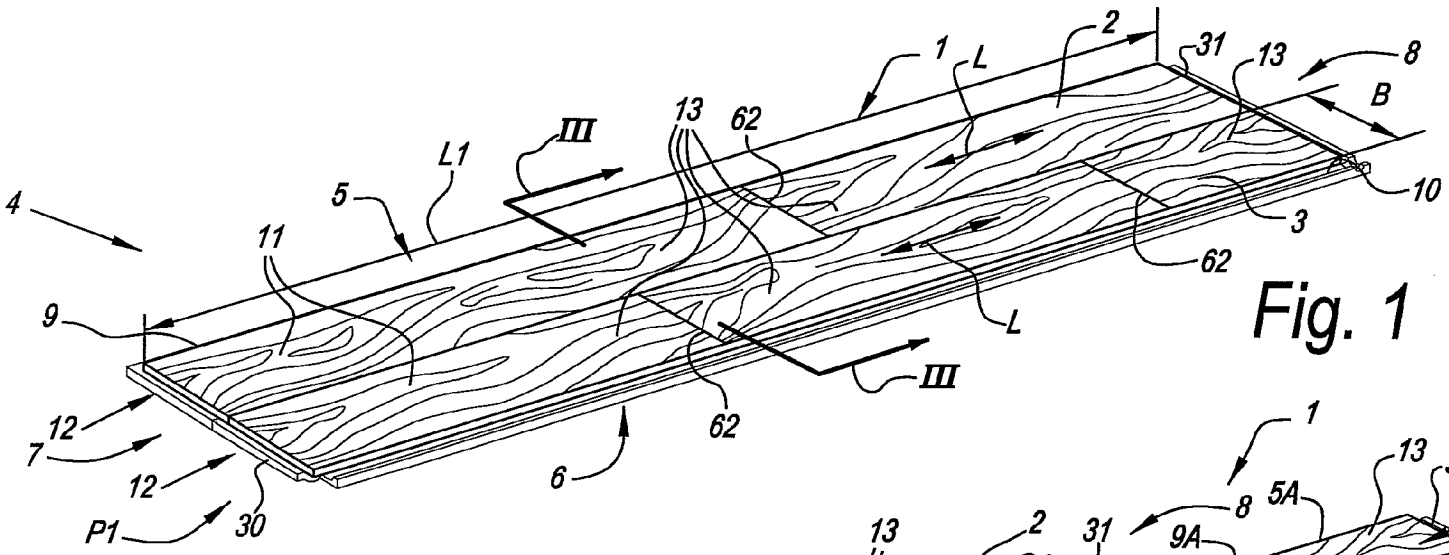
FIG. 1 in perspective represents a floor element according to the invention.

FIG. 1 represents a floor element 1 according to the invention. Such floor element 1, as aforementioned, is composed, as aforementioned, starting from at least two components 2-3, into an entity 4. In the example, the floor element comprises two components which are realized as planks or laths, which, as FIG. 1 shows, can adopt a mutual position P1 in which the floor element 1 has a globally rectangular and in this case oblong shape. In this mutual position P1, it is clear that the depicted floor element 1 has, at least at two opposite edges 5-6, for example, at the opposite long edges 5-6 and/or short edges 7-8, coupling means or coupling parts 9-10. In this case, the coupling means substantially are made in the form of a tongue 9 and a groove 10 and allow for that two of such floor elements 1 can be coupled to each other at the respective edges 5-6-7-8.

Each of said components 2-3 has a substantially flat side forming a decorative side 11. These decorative sides 11 are situated at the upper side of the composed floor element 1, where in this case they form or represent two adjacent rows 12 of decorative parts 13. Thus, the floor element relates to an example of an improved multi-plank element, in particular a two-plank element.

Figure 2:
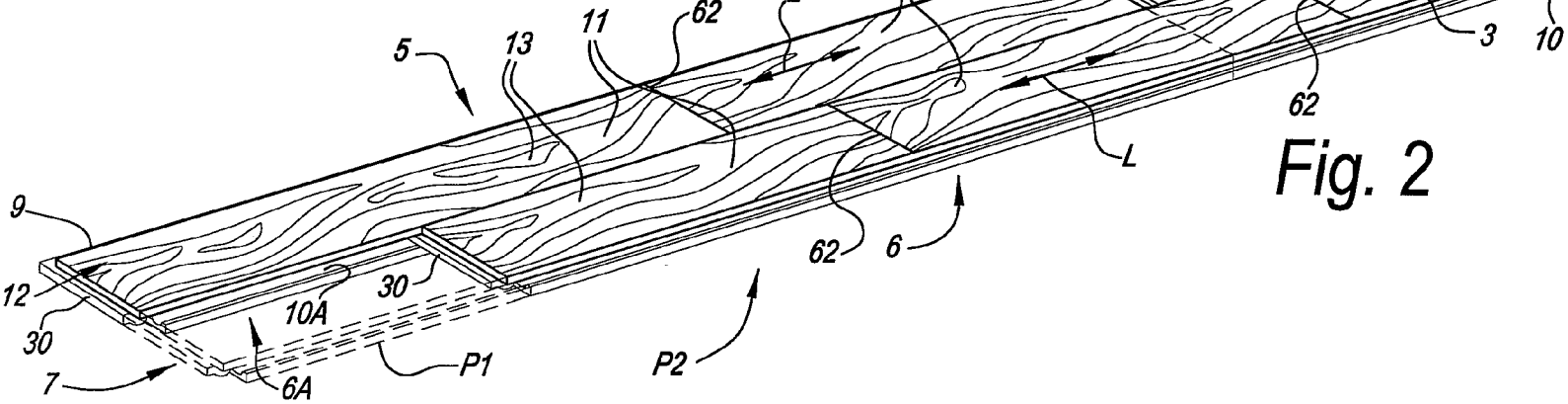
FIG. 2 represents the floor element of FIG. 1, wherein two components thereof adopt another mutual position than this is the case in FIG. 1.

The improvement obtained according to the invention in this kind of floor elements 1, is obtained by the fact that, although said components 2-3 form an entity 4, they still can adopt, as FIG. 2 shows, at least also a second mutual position P2, whether or not by disrupting said entity 4. Said components 2-3 can, in this case in their longitudinal direction L, be shifted in respect to each other. By positioning the floor elements 1 such in the floor covering that the components 2-3 are situated in this second mutual position P2, it is obtained that said rows 12 of decorative parts 13 of this improved two-plank, at said short edges 7-8 of the floor element 1, do no longer simultaneously merge into the decorative portions 13 of a similar adjacent floor element. It is noted that the entity 4 presented here allows more than two mutual positions P1-P2 of the components 2-3, as the components 2-3 can be shifted along each other over the entire length L1 of a side 5 of the floor element 1.

Figure 3:
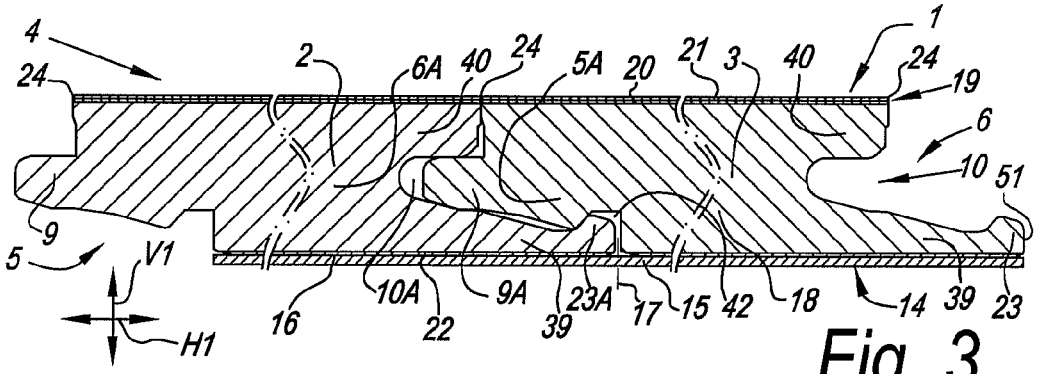
FIG. 3 represents a section according to the line III-III represented in FIG. 1.

FIG. 3 shows that each of the two components 2-3 can be provided with at least a pair of complementary coupling means or coupling parts 9-10A-9A-10, by means of which they can be connected mutually or with others of such components in horizontal direction H1 as well as in vertical direction V1. As mentioned in the introduction, it is known to apply pairs of complementary coupling means in order to have floor panels cooperate with each other. It is noted that the represented coupling means 10A-9A allow that the components 2-3 can be shifted along their coupled sides 5A-6A in mutual respect, and they also may be released from each other at least by means of an angling movement. Further, it is noted that the coupling means 9-10, by which the floor elements 1 can be coupled to each other, in the example form part of said pairs of complementary coupling means 9-10A-9A-10 present at the components 2-3. As will become evident in further examples, this is not necessarily the case. For clarity's sake, it is noted that coupling means which, in the first place, are intended for mutually connecting components, are indicated by a reference number with the suffix A in this description and the accompanying drawings, whereas coupling means which, in the first place, are intended for mutually connecting floor elements, are indicated by a reference number without a suffix.

The particularity of the floor element 1 from the FIGS. 1 to 3 consists in that this floor element 1 is equipped with entity-forming means 14, which are especially provided for effecting an entity 4 among said components 2-3. In the example, the respective entity-forming means 14 comprises a layer 15, which is provided at the underside 16 of both components 2-3, such as a paper layer, which is attached or adhered to the underside 16 of at least one and preferably two components 2-3.

Although by means of said layer 15 an entity 4 has been effected between the two components 2-3, the cooperation of this layer 15 with said coupling means 9A-10A still allows that the components 2-3 can adopt different mutual positions P1-P2. Adopting another position may take place by either unlocking or not unlocking the coupled sides 5A-6A of the components 2-3. When changing the position, for example, from the mutual position P1 of FIG. 1 to the mutual position P2 of FIG. 2, the entity 4 effected by the entity-forming layer 15 possibly may be disrupted in that this layer 15 tears, for example, at the depicted dashed line 17 and that the entity 4 is irrevocably lost, and/or in that the glue connection of this layer 15 with the components 2-3 is disrupted, whether or not in an irrevocable manner. According to a not-represented variant of this embodiment, one may also work with entity-forming strips instead of an entity-forming layer 15, which strips then preferably are situated at several locations in longitudinal direction L of the components 2-3. According to another variant, it is also possible that such layer or such strip are situated at the upper side or decorative side 11 of the floor element 1. Such entity-forming means then, for example, may be removed after having installed the floor covering and, in the case of a layer, also offer the additional advantage of protecting the decorative side 11 during production, transport and installation of the floor elements.

The components represented in FIG. 3 have the construction of a laminate floor panel. For this purpose, they comprise a core 18 and a provided-thereon top layer 19 on the basis of synthetic material. Here, this relates in particular to a laminate top layer, which is manufactured by means of a DPL method and comprises both a so-called decor layer 20 having a printed decor, and a protective wear-resistant layer 21 above the decor, such as a so-called overlay. At the underside 16 of the components, there is also a so-called backing 22, which also comprises synthetic material, such as a cured melamine resin.

Figure 4:
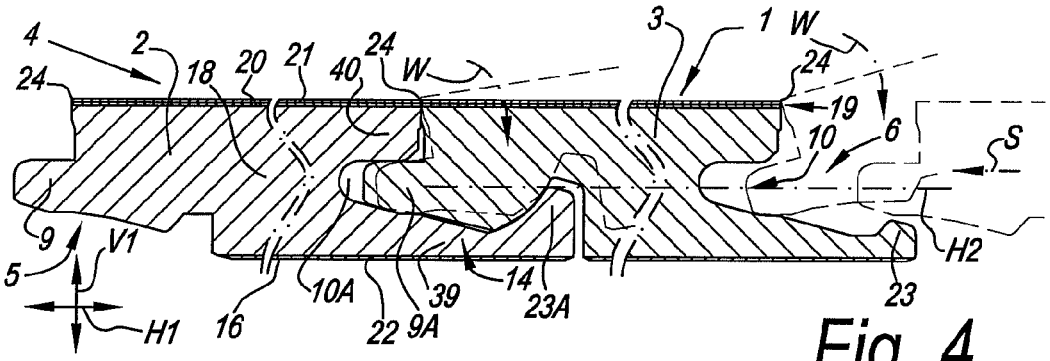
FIGS. 4 to 6 represent variants of the floor element of FIG. 1, in a view similar to that of FIG. 3.

FIG. 4 shows another possibility for the embodiment of the entity-forming means 14. Here, they consist at least of mechanical coupling means 9A-10A allowing that the components 2-3 of the same floor element 1 can cooperate with each other. These coupling means 9A-10A are made differently than the mechanical coupling means 9-10, which the floor element 1 as such is having at least at two opposite edges 5-6 and which allow that two of such floor elements 1 as such can be coupled to each other. In the example, the being "different" of the coupling means 9A-10A, which form a part of the entity-forming means 14, becomes evident from the difference in geometry between the coupling means 9-10 and the entity-forming coupling means 9A-10A. For example, the entity-forming means 14 at the groove side 6A thereof form an upright-standing locking element 23A, which effects the horizontal locking among the components 2-3 and has a highest point, which is situated in a horizontal plane H2, wherein this plane H2 extends above the upright-standing locking element 23, situated at the groove side 6, of the coupling means 10 of the floor element 1. In this case, the being "different" of the entity-forming means 14 is also emphasized by a difference in functionality. While the coupling means 9-10 of the floor element 1 allow that these floor elements can be coupled with a horizontal shifting movement S towards each other as well as with an angling movement W along their upper edges 24, the entity-forming means 14 from the example solely allow a coupling by means of an angling movement W. From the above, it is clear that the illustrated entity-forming coupling means 9A-10A, when coupling the respective components 2-3, effect a locking in horizontal H1 as well as in vertical direction V1 of the components 2-3.

Figure 5:
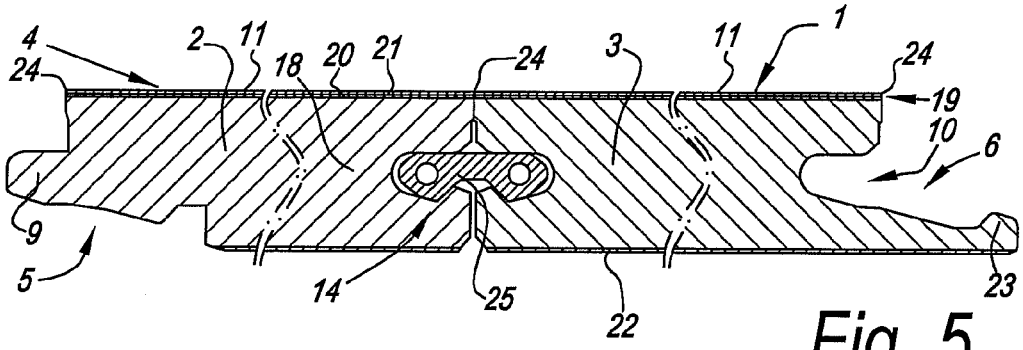

FIG. 5 shows an example, wherein the entity-forming means 14 are formed by a separate attachment means 25, more particularly by a separate mechanical coupling part, which clearly is different from the coupling means 9-10, which allow that the floor element as such can be coupled to other similar floor elements 1.

Figure 6:
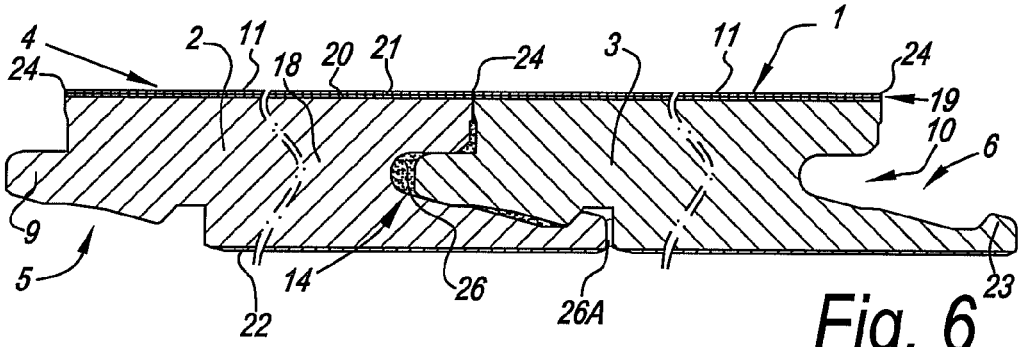

FIG. 6 also shows that entity-forming means 14 can be chosen, which consist at least of a glue connection 26, which possibly is releasable and by which components 2-3 of one and the same floor element 1 are attached to each other laterally. Such glue connection 26 can be provided at any location. As an alternative, the glue connection 26A is shown schematically. The glue connections 26-26A do not have to extend over the entire length of a component 2-3, but can be provided locally, possibly dropwise, over this length.

Figure 7:
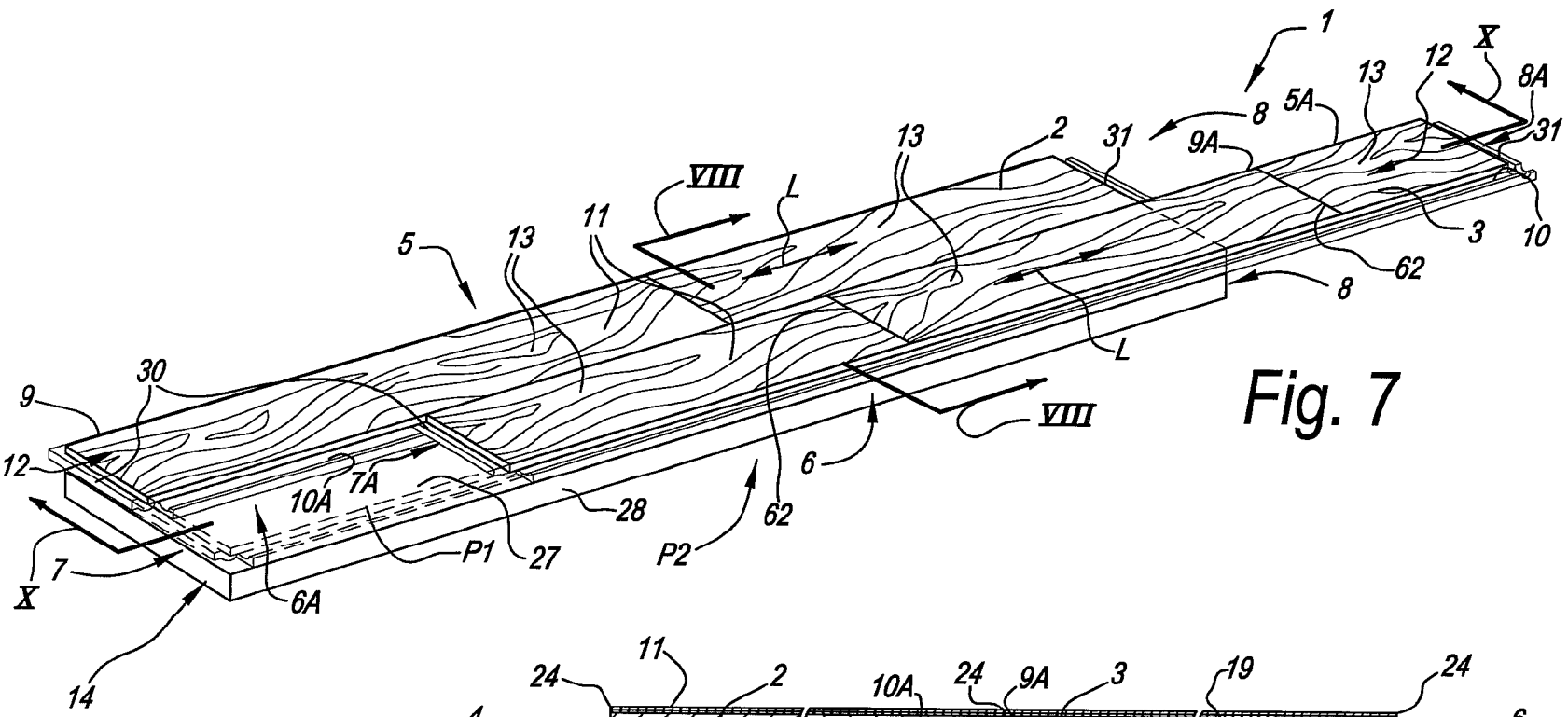
FIG. 7 represents a variant of the floor element of FIG. 1 in a view similar to that of FIG. 2.

FIG. 7 shows in perspective another floor element 1, wherein the entity-forming means 14 are made as a portion 27 of the floor element 1, which portion can be situated beneath the first component 2 as well as beneath the second component 3.

Figure 8:
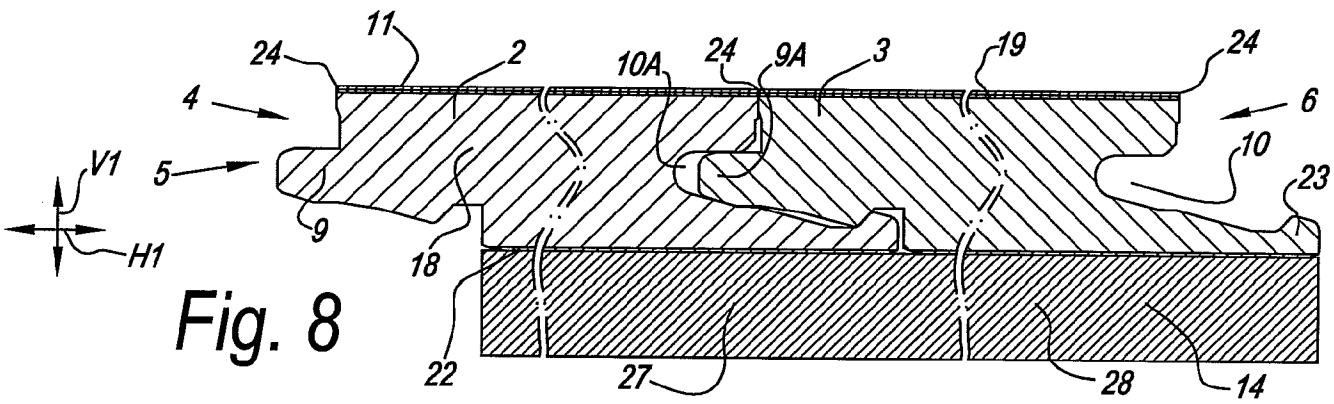
FIG. 8 represents a section according to the line VIII-VIII represented in FIG. 7.

FIG. 8 shows that this portion 27 can be designed as a basic structure 28, upon which each of the components 2-3 can be situated. This basic structure 28 can consist, for example, of a sound-dampening material, such as so-called softboard or polyethylene, or possibly can comprise, as in FIG. 9, a sound-dampening layer 29. By means of this basic structure 28, also other effects can be achieved. Preferably, at least one of the components 2 is fixedly connected to the basic structure 28, for example, by gluing this component to the basic structure 28, while at least one of the other components 3 is lying freely on said basic structure 28. In this manner, the complexity of the floor element 1 is restricted, whereas still an entity 4 with components 2-3 that are movable in respect to each other is obtained. Of course, in such case the basic structure 28 is displaced together with the component 2 fixedly attached thereto. By connecting, in any manner, at least one of the components 2 with a basic structure 28, a floor element with an increased rigidity is obtained, with all beneficial effects thereof. So, for example, such floor element 1 will show less tendency to warp, which results in an increased installation comfort. It is noted that a fixed connection of a component with a basic structure may also be obtained in that the respective component is formed in one piece with the basic structure.

Figure 10:
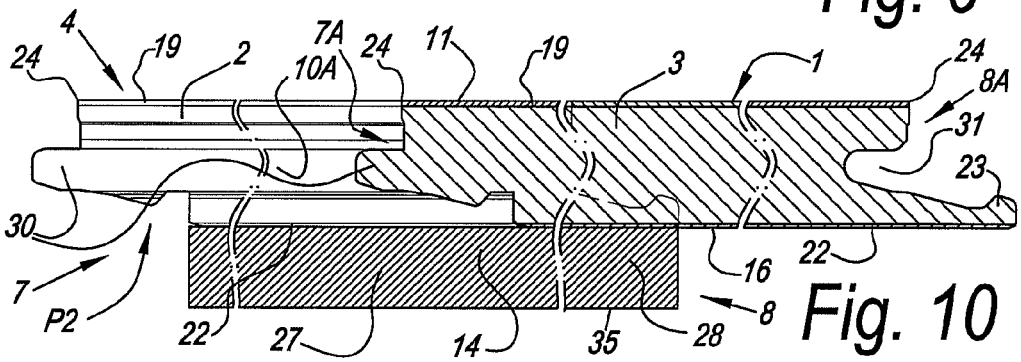
FIG. 10 represents a section according to the line X-X represented in FIG. 7.

As already became evident from FIGS. 1, 2 and 7, by FIG. 10 it is emphasized again that the components 2-3 of the floor elements according to the invention also may be provided with coupling means 30-31 at a second pair of opposite sides 7A-8A, which coupling means, for example, allow that the components 2-3 of different floor elements 1 can be coupled to each other. In the example, this also relates to coupling means or coupling parts 30-31, by which a locking in horizontal H1 as well as in vertical direction V1 can be obtained at the respective sides 7A-8A.

It is clear that according to a not-represented variant, the coupling means 9 and 10, at the long sides 5-6 of the floor element, as well as the coupling means 9A-10A, can be made differently than the coupling means 30 and 31 at the short sides of the floor element. In a practical embodiment thereof, the coupling means 9-10 and/or 9A-10A, for example, will be made such that the components, at their long sides, laterally can be joined into each other exclusively by means of an angling movement and not by means of a shifting and engaging movement, whereas the coupling means 30-31 in their turn allow a joining by means of a shifting and engaging movement.

Figure 11:
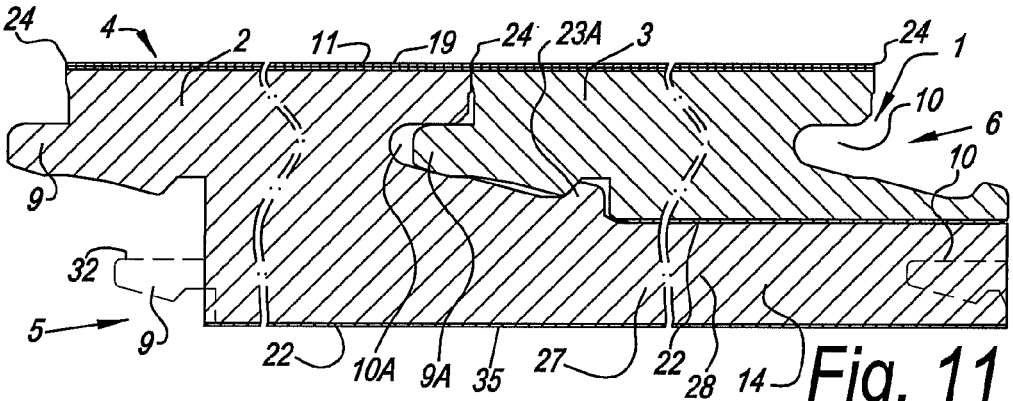
FIG. 11, in a view similar to that of FIG. 8, represents another variant.

FIG. 11 represents a floor element according to the invention, wherein said entity 4, which is effected by the entity-forming means 14, consists at least in that a first component 2 of said components 2-3 extends up to beneath another component 3 of said components and in this case in this manner forms a basic structure 28. It is illustrated in dashed line 32 that it is not excluded that the basic structure 28 of the floor element 1 as such is provided with coupling means 9-10, which then allow that the basic structures 28 of two of such floor elements 1 can be coupled to each other.

Figure 12:
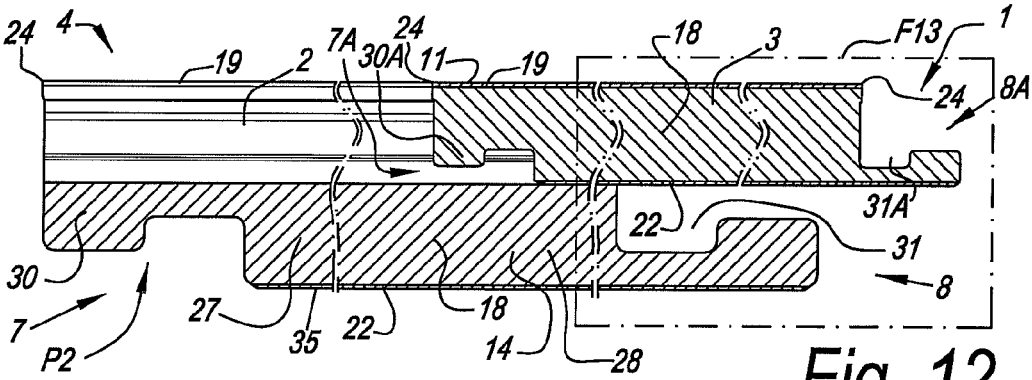
FIG. 12, in a view similar to that of FIG. 10, represents a variant.
Figure 13:
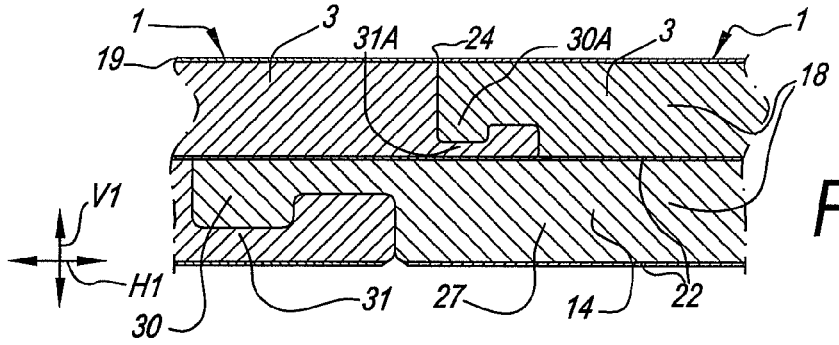
FIG. 13 represents a view onto the region indicated by F13 in FIG. 12.
Figure 14:
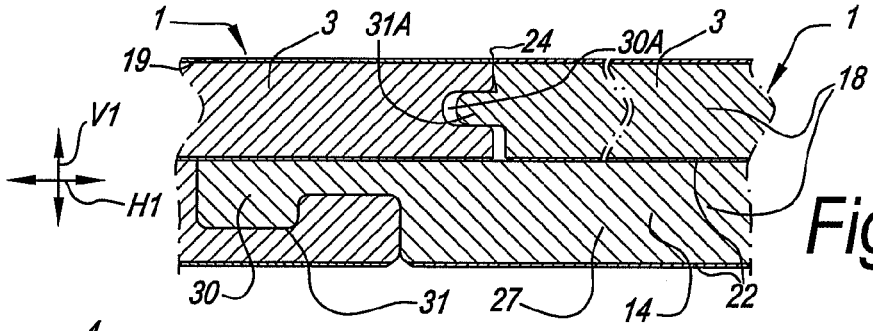
FIG. 14, in a similar view, represents a variant.

FIG. 12 represents, by means of the floor element 1 of FIG. 11, another possibility how the floor elements 1 of the invention can be coupled at their short sides 7-8. To this aim, at least the second component 3 as well as the basic structure 28 are provided with mechanical coupling parts 30-30A-31-31A, which as such solely allow a locking in horizontal direction H1. As FIG. 13 shows, by the cooperation of the coupling means 30A-31A of the components 2-3 and the coupling means 30-31 of the basic structure 28 nevertheless a locking in vertical direction V1 can be obtained. The vertical locking is effected in that at least one of the components 3 extends in the floor covering up to over the edge 8 of the basic structure. FIG. 14 represents another similar embodiment, wherein the coupling means 30A-31A of the component 3 solely allow for a vertical locking.

Figure 9:
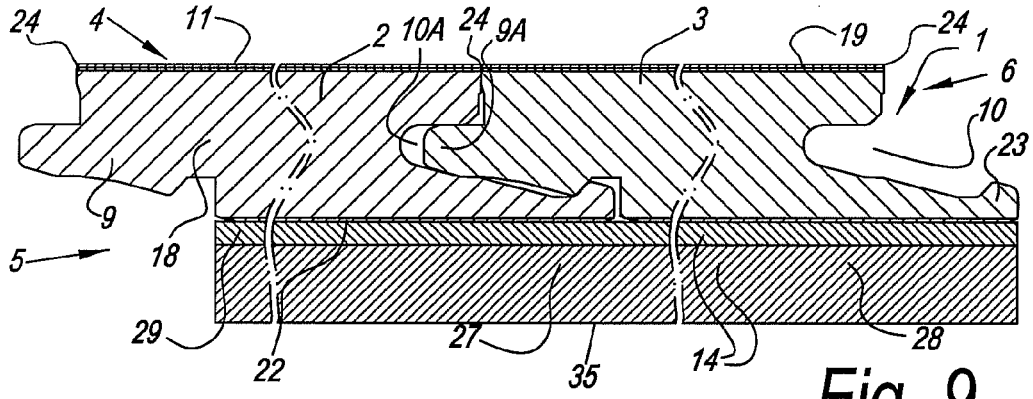
FIG. 9 represents a variant of the floor element of FIG. 7 in a view similar to that of FIG. 8.
Figure 15:
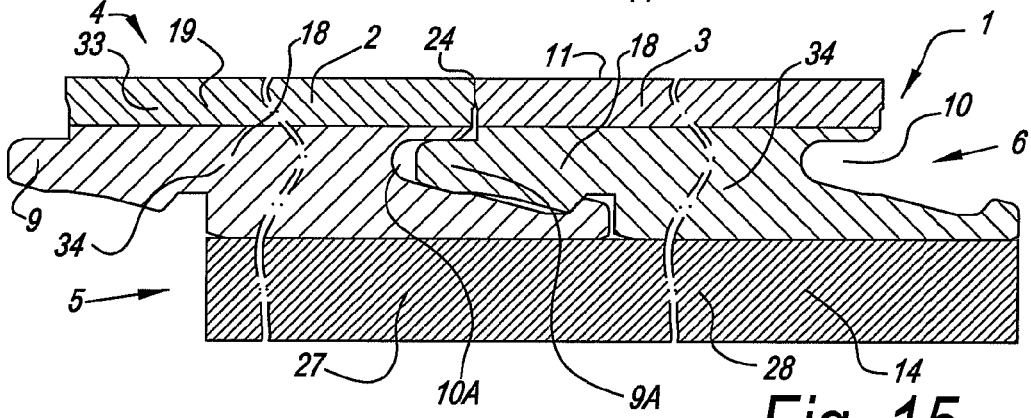
FIGS. 15 and 16 represent another variant, respectively in a view similar to that of FIG. 9 and FIG. 10.

FIG. 15 represents a floor element 1 similar to that of FIGS. 8 and 9. However, the components 2-3 are not constructed as laminate floor panels, but at least one and in this case both components 2-3 thereof are constructed as panels for so-called dual layer parquet (Dutch: tweelaagsparket; German: Zweischichtparkett). As known as such, for example, from EP 1 589 160, such panels substantially consist of two layers of wood, namely, on the one hand, a surface layer 33 of hard solid wood, which forms the decorative side 11, and on the other hand a core layer 34 of softwood. This embodiment of the invention is particularly interesting for manufacturers of panels for dual layer parquet. For the production of the components 2-3, they may in fact apply their known production methods, whereas for obtaining the advantages of the invention, they may solely provide a basic structure 28. In such case, preferably at least one of the components 2 is fixedly connected to the basic structure 28, whereas at least another component 3 is lying freely on this basic structure 28, however, cooperates or can cooperate with the fixedly connected component 2. Basic structures 28 on the basis of wood or ground wood, such as softboard, are preferred for embodiments with components 2-3 that are constructed as dual layer parquet panels.

Figure 16:
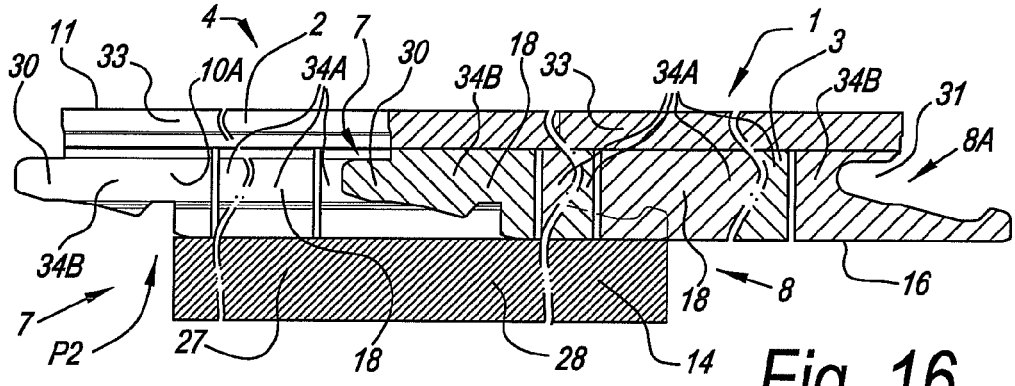

FIG. 16 shows that the core layer 34 of such dual layer parquet panels may be made as a so-called lamellar core, which consists of a plurality of laths 34A-34B oriented in crosswise direction, which laths as such may consist, for example, of solid wood, such as wood which is softer than the aforementioned surface layer 33. Examples of wood which can be applied for these laths are pine wood or poplar wood. It is not excluded that a number or all of the aforementioned laths 34A-34B can be made of another, preferably wood-based, material. The laths 34B, of which the coupling means 30-31 are made in one piece, may consist, for example, of MDF or HDF. From WO 97/47834, it is already known that such fiberboard has ideal features for forming coupling means.

Figure 17:
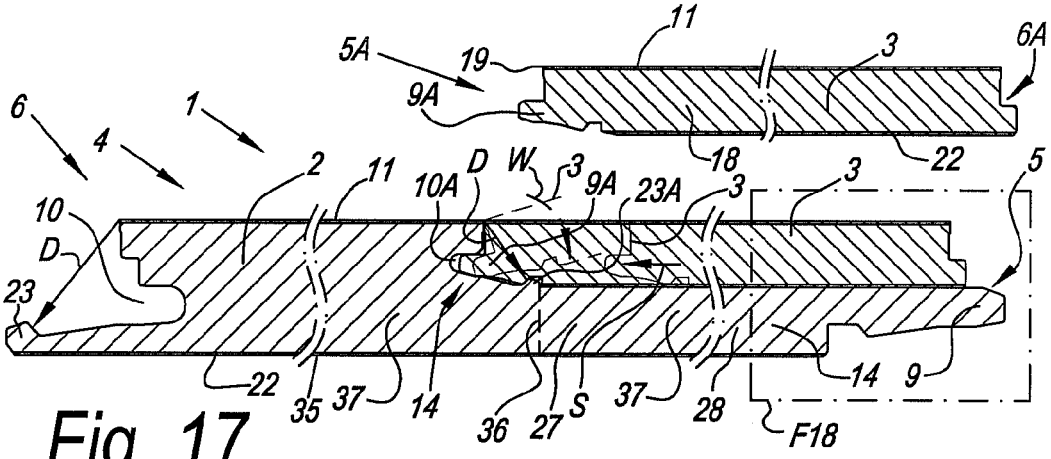
FIGS. 17 and 18 in cross-section represent another variant, wherein FIG. 18 offers a view to the region indicated by F18 in FIG. 17.

FIG. 17 shows another important embodiment of a floor elements 1 according to the invention, wherein the entity-forming means 14, apart from a basic structure 28, also comprise mechanical coupling means 9A-10A, which are differing from the coupling means 9-10, which latter allow to couple such floor elements 1 as such. In the depicted entity-forming means 14, the being "different" of the entity-forming coupling means 9A-10A substantially can be reduced to the fact that they are made smaller. Amongst others, the difference in the distance D between the locking surface at the upright-standing locking element 23-23A of the groove 10-10A and the upper edge 24 of the respective component 2, floor element 1, respectively, can be regarded as relevant for the difference in the dimensions between the coupling means 9-10 and 9A-10A. These distances may have a ratio of, for example, 5 to 4. Preferably, this ratio is larger than 3 or still better is larger than 2 or even larger than one and a half.

Figure 18:
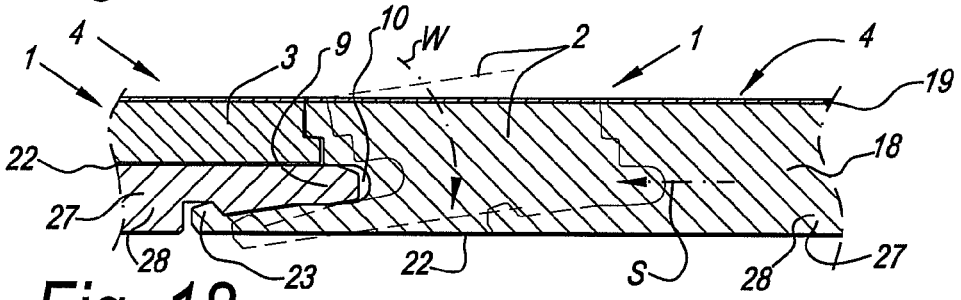

FIG. 18 represents how floor elements 1, such as those from FIG. 17, can be coupled to each other. This is possible, for example, by means of a horizontal shifting movement S, or by means of an angling movement W around the respective edge 5-6. By coupling the floor elements 1, it can be provided for that the component 3, which is lying freely on the basic structure 28 of the floor element 1, is tensioned between the first component 2 and the other floor element 1 coupled to this floor element 1.

Figure 19:
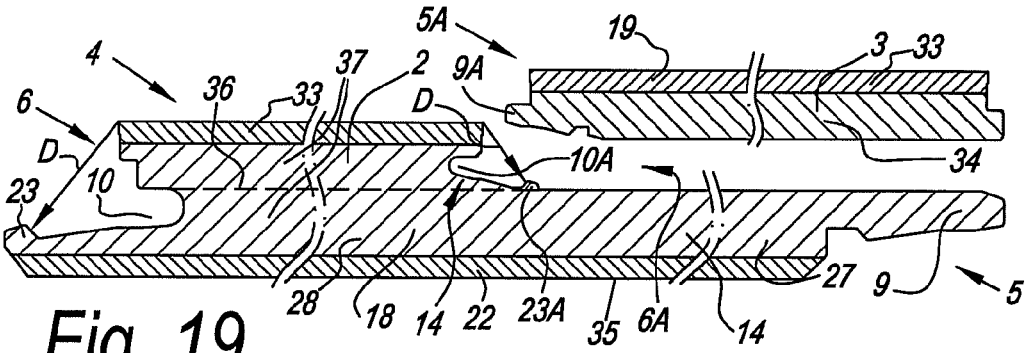
FIGS. 19 and 20 represent still more variants in a view similar to that of FIG. 15 or 17.

FIG. 19 represents a floor element 1 similar to the floor element 1 of FIG. 17, however, with another construction than a laminate floor panel. Both components 2-3 have a core 18 with a top layer 19 provided thereon, said top layer being wood-based. This may relate, for example, to a veneer top layer, or, as this is the case here, relate to a wooden top layer 19, which is thicker than veneer. The core 18 of the floor element 1 can consist or be composed, for example, of softwood, such as poplar or pinewood. In the example, at the underside 35 of the floor element 1 or the basic structure 28 also a backing 22 of solid wood is provided. Of course, it is possible that such backing 22 is present in all components 2-3. It is noted that here, as it was the case in FIGS. 15 and 16, at least one of the components 3 can be made as a panel of so-called dual layer parquet and that said core 18 can be composed of laths.

Figure 20:
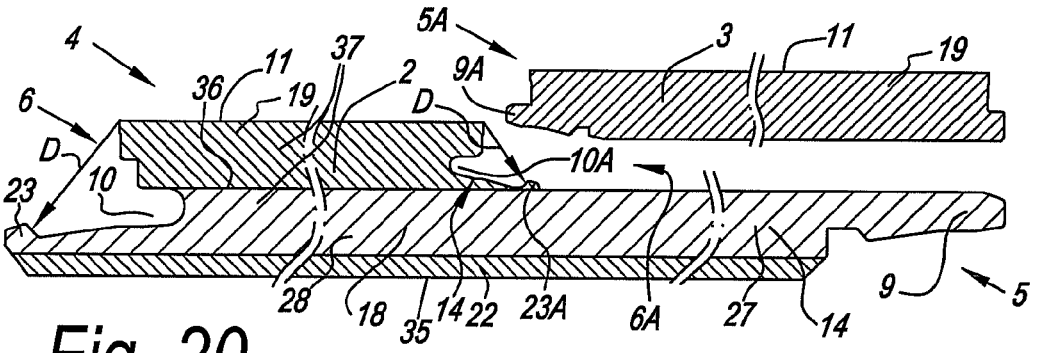

FIG. 20 shows a variant of the floor element 1 of FIG. 19, wherein the top layer 19 is made at least equally thick as one of said components 3. This embodiment is simple to manufacture. It is clear that a construction, in which at least one of the components 3 consists exclusively of a, whether or not composed, top layer 19, also offers advantages when the top layer 19 is constructed or composed of other materials than wood.

In FIGS. 17 and 19, it is also shown in dashed line 36 that the basic structure 28 of such floor element 1 can be composed of different parts 37, which are fixedly connected to each other, for example, are glued together. In this manner, it can be prevented that there is an excessive material loss during the manufacture of such floor elements 1.

Figure 21:
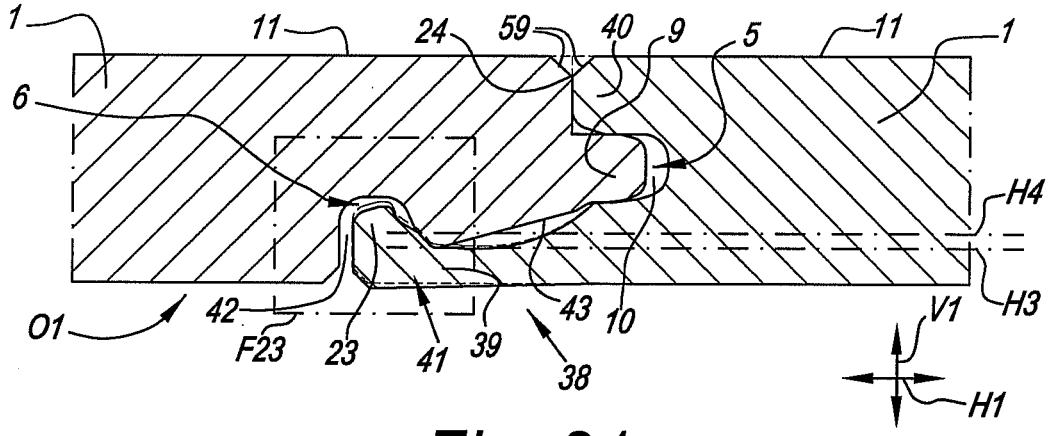

FIG. 21 shows a locking system 38 for laterally coupling floor elements 1 by means of an angling and/or shifting movement, wherein this locking system also shows the characteristics of the fourth aspect. Such locking system 38 consists at least of coupling means 9-10, which substantially are made as a tongue 9 at the side 5 of a first floor element 1 and a groove 10, bordered by means of a lower lip 39 and an upper lip 40, at the side 6 of a second floor element 1. These coupling means 9-10 further are provided with locking means 41. As depicted here, these locking means 41 comprise a projecting locking element 23 at one of said lips 39, in this case an upright-standing locking element 23 at the lower lip 39, and a cooperating-therewith locking element 42 at the tongue 9, in this case, at the underside 43 of the tongue 9.

Figure 22:
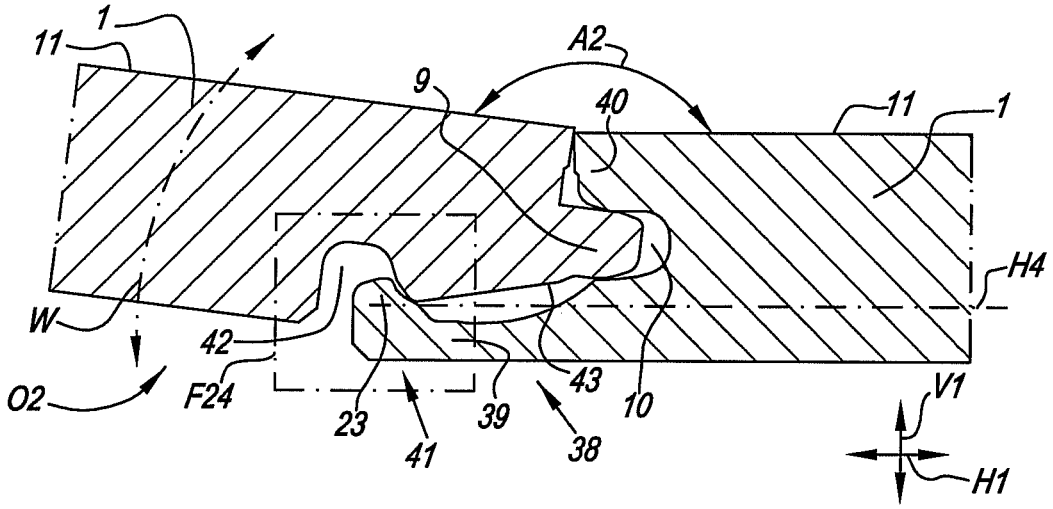
Figure 23:
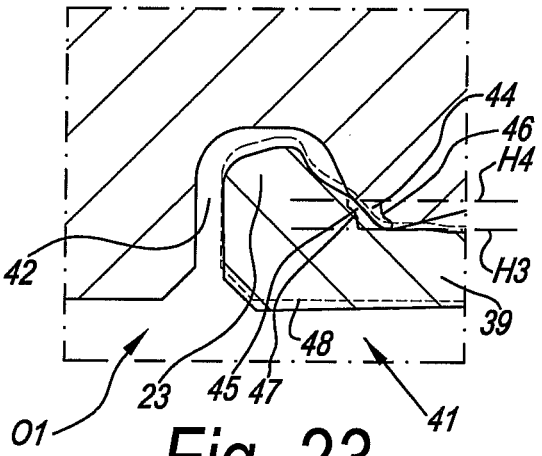
Figure 24:
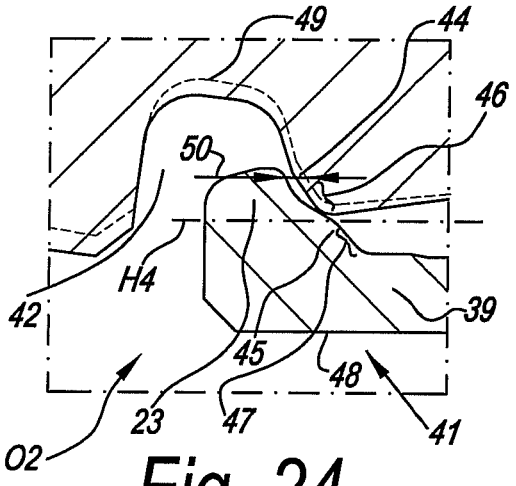

FIGS. 21 and 22 show two mutual orientations O1-O2, which can be adopted by two floor elements 1 coupled by means of the aforementioned locking system 38. FIGS. 22 and 23 respectively show the mutual orientations from FIGS. 20 and 21. FIGS. 21 and 23 show the same first mutual orientation O1, wherein the top surfaces or decorative sides 11 of the floor elements 1 substantially are situated in the same plane and wherein surfaces 44-45 of said locking elements 23-42 show contacting portions 46-47, which extend between a lower horizontal plane H3 and an upper horizontal plane H4. FIGS. 22 and 24 show the same second mutual orientation O2, in which the top surfaces or decorative sides 11 enclose an angle A2 of less than 180 degrees and said surfaces 44-45 are free from mutual contact. Moreover, the portion 46, coming in to contact in a first mutual orientation O1, of a first of these surfaces 44, extends in this second mutual orientation O2 above said upper horizontal plane H4. However, the first and the second floor element 1 in the second mutual orientation O2 still are locked together in the vertical V1 as well as in the horizontal direction H1. It is noted that, amongst others, in the illustrated locking system 38, the floor elements 1 can be brought, with a relative angling movement W around the coupled side, from the first to the second mutual orientation O1-O2. Further, it is noted that mutual orientations with the characteristics of said second mutual orientation O2 preferably can be adopted over an angling-in range of at least 5 degrees, and still better of at least 10 or at least 15 degrees. The fact that the horizontal and vertical locking can be maintained over such range is particularly useful when installing floor elements 1, which are provided with such locking system 38 at least at two opposite sides 5-6, and with components 2-3 of floor elements 1, which can cooperate by means of such locking system 38.

From FIG. 23, it is evident that the lower lip 39, in the first mutual orientation O1, is in a bent-out position. For comparison, in dashed line the contour 48 of the lower lips 39 before coupling is represented. Such bending-out may result, for example, to a pretension in the locking system 38, which as such is known from WO 97/47834. Whether there is a pretension or not, it is preferred that the floor elements 1 in said first mutual orientation O1, as it is the case here, are coupled free from play.

From FIG. 24, it is evident that the surfaces 44-45, which in FIG. 23 form a mutual contact, are free from contact in the second mutual orientation O2. The portion 46, which comes into contact in the first mutual orientation, now is situated entirely above said upper horizontal plane H4. In this second mutual orientation O2, the lower lip 39 is less deformed than in the first mutual orientation O1. As shown, the lip 39 has completely returned into the position it had before the coupling of the floor elements 1. It is also possible that in the second mutual position O2 a clearance 50 is present between the coupled sides. Such a position is represented in dashed line 49 in FIG. 24. This clearance 50 results in that the floor elements 1 can move over a limited distance in horizontal direction H1. However, in the example the resulting moving space is so small that the aforementioned locking in vertical direction V1 and horizontal direction H1 is maintained over the entire range of the possible movement.

Of course, it is possible that the floor elements 1 can adopt still other mutual orientations than orientations with the characteristics of said first or second mutual orientation O1-O2, such as the third mutual orientation mentioned in this respect in the introduction, wherein preferably again a locking free from play is obtained and/or said lower lip is elastically deformed again.

Figure 25:
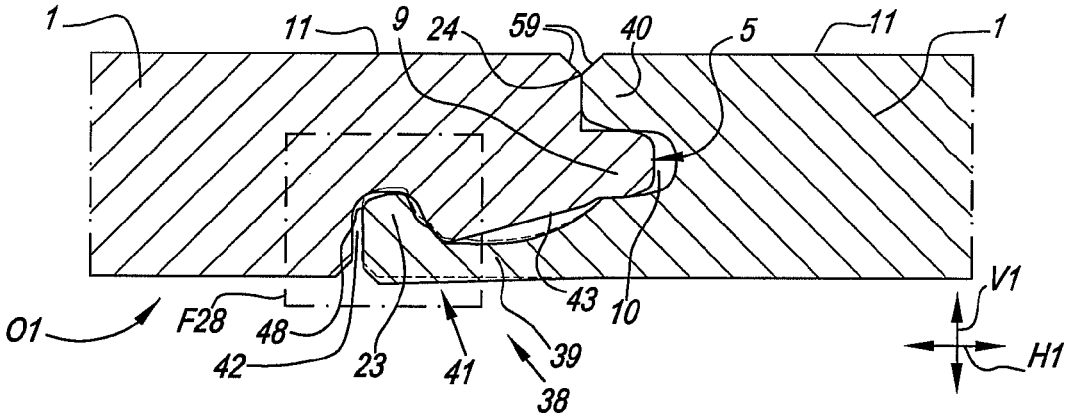

FIG. 25 shows another locking system 38 for laterally coupling together floor elements 1 by means of an angling and/or shifting movement, however, with the characteristics of the fifth aspect of the invention. From the figure, it is evident that the locking system 38 globally is constructed in the same manner as the locking system 38 of FIG. 21. Further, the locking system 38 is constructed such that the lower lip 39 in the normal usage position of the floor elements 1, namely the position in which the top surfaces or decorative sides 11 substantially are situated in the same plane, is elastically deformed. The particularity of the here represented locking system 38 is that the lower lip 39, when uncoupling the first and second floor elements 1 by means of an angling movement W, undergoes at least three successive changes.

Figure 26:
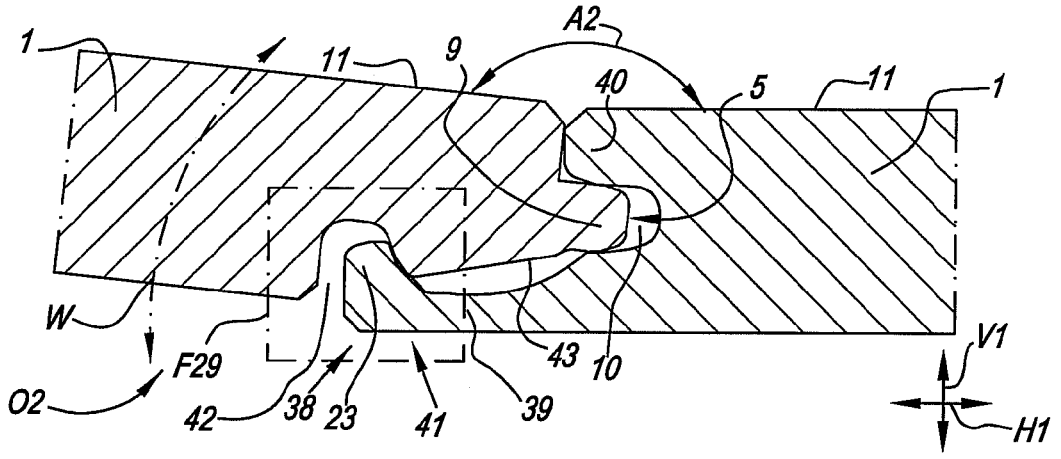

The lower lip 39 undergoes a first change when the floor element 1 is brought from the orientation shown in FIG. 25 into the orientation shown in FIG. 26. The change here consists of a decrease of the elastic deformation, in the present case, the bending, of the lower lip 39.

Figure 27:
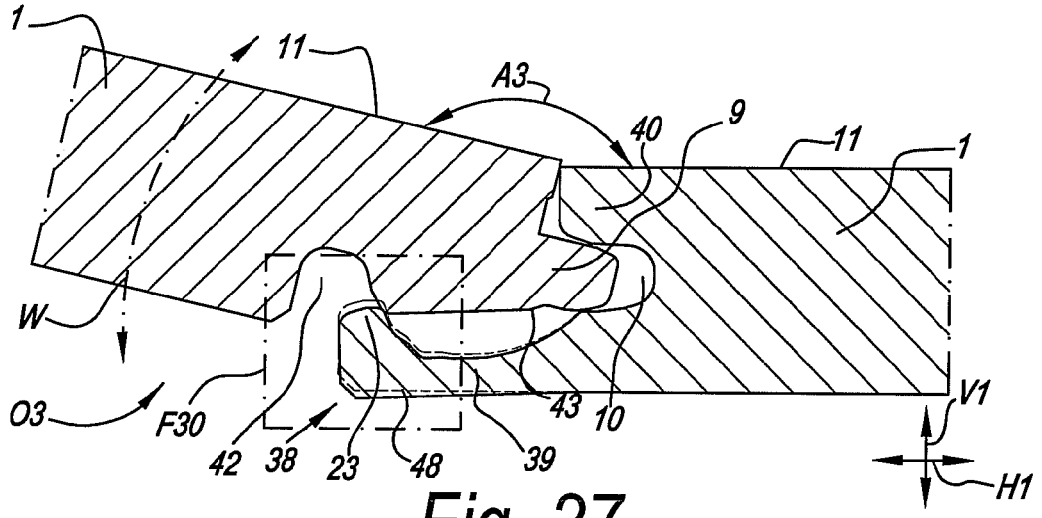

The second change takes place when the floor element is angled still further until it reaches the orientation represented in FIG. 27. This second change consists in an increase of the elastic deformation or bending of the lower lip 39.

The third change manifests itself when the floor element 1, from the orientation represented in FIG. 27, is entirely angled out of the other floor element. This third, and in the example the last, change thus consists again of a decrease of the elastic deformation or bending of the lower lip 39.

Figure 28:
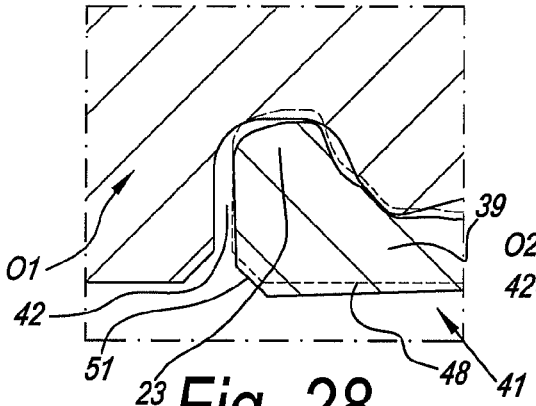
Figure 29:
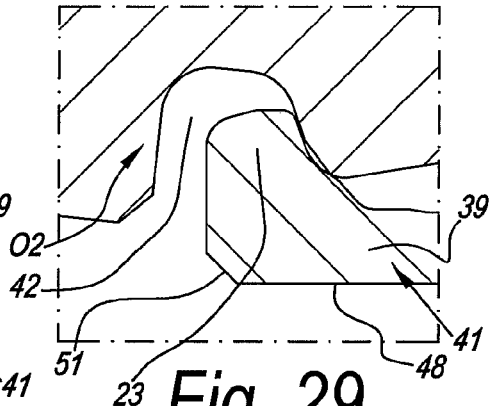
Figure 30:
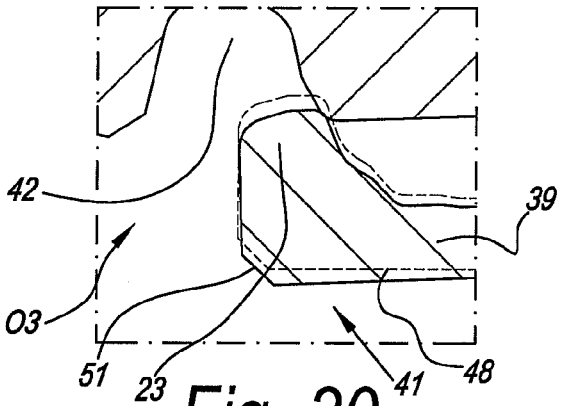

The FIGS. 28 to 30 show, at a larger scale, the deformation, bending or displacement of the lower lip 39 in the proximity of its distal end 51, for the mutual orientations of the floor elements 1 shown respectively in FIGS. 25 to 27.

By comparing the contour 48 of the lower lip 39, said contour being represented in dashed line, for coupling the floor elements 1, it is evident from FIGS. 28 and 29 that in the example said first change or the decrease of the deformation results in a completely relaxed lower lip 39, whereas the bending of this lower lip 39 during the second change increases again until a position or bending, shown in FIG. 30, is reached, which is comparable to the bending in FIG. 28. However, it is not excluded that the bending, which is reached after the second change, is smaller or larger than the one present in the normal usage position. It is noted that normal values for the displacement of the lower lip 39 in the proximity of its distal end may vary between several hundredths up to several tenths of millimeters.

To those skilled in the art, it is evident how the embodiments of floor elements 1 according to the first aspect of FIGS. 1 to 20 can be expanded to and how the locking systems 38 of the FIGS. 21 to 30 can be applied in floor elements 1 with more than two components 2-3, for example, with the intention of forming improved three-, four- or multi-plank elements.

In general, such embodiments have the characteristics that, starting from three or more components 2-3, by means of one or more entity-forming means 14, for example, by means of a basic structure 28, an entity 4 is effected, wherein at least one of these components 3, and preferably at least two, and still better all components can adopt different positions P1-P2 in respect to all remaining components 2 of this floor element 1. Further, it is preferred that each of these components 2-3 has a decorative side 11, which is situated at the upper side of the floor element 1. As an example, in the FIGS. 31 to 40 and 45 to 48 several possible embodiments with their application are shown.

Figure 31:
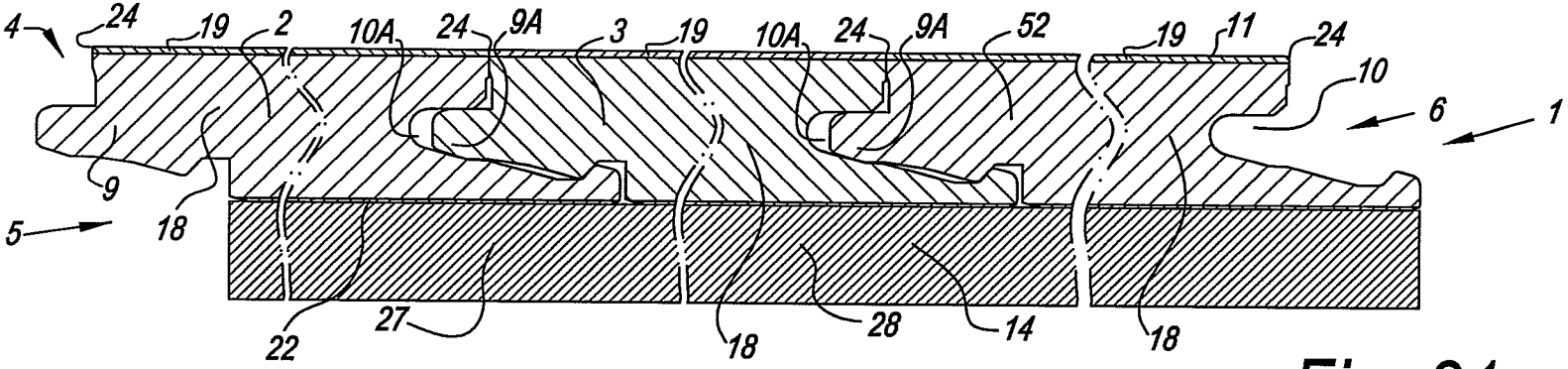
FIGS. 31 to 33 represent still further variants of floor elements according to the invention in a view similar to that of FIG. 8.

FIG. 31 represents a floor element 1 according to the present invention, similar to the embodiment of FIG. 8, 9 or 15. Where with the floor element 1 of FIG. 8, 9 or 15 an improved two-plank element had been intended, the floor element 1 of FIG. 31 aims at an improved three-plank element. To this aim, the floor element 1 thus also comprises three components 2-3-52, which each have a decorative side 11. Starting from these three components 2-3-52, an entity 4 is formed by means of an entity-forming means 14, in this case, a basic structure 28. At least one of these components 2-3-52, and preferably all components 2-3-52, can adopt different positions in respect to all remaining components. Preferably, at least one of the components 2 is fixedly connected to the basic structure 28, whereas at least one of the remaining and preferably both remaining components 3-52 are lying freely on the basic structure 28.

Figure 32:
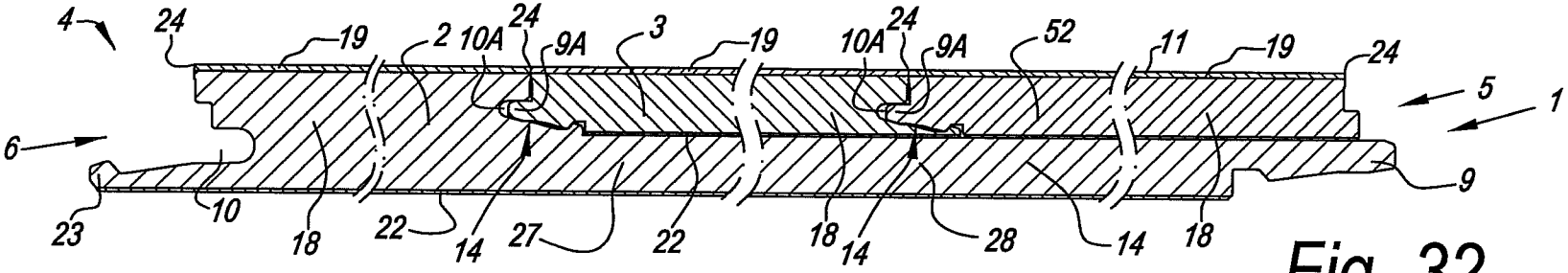

FIG. 32 also shows an embodiment, however, now similar to that of FIG. 17, which can result in an improved three-plank element. Herein, the entity-forming means 14 consists of a portion 27 of the first component 2, which extends at least beneath both other components 3-52.

Figure 33:
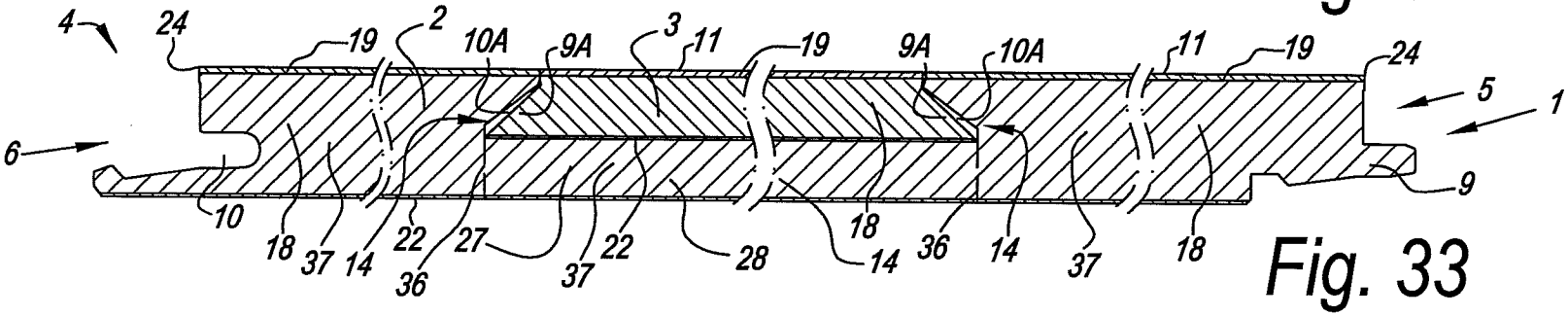

FIG. 33 also relates to an embodiment, which can result in an improved three-plank element, however, which is solely constructed of two components 2-3, which can adopt mutually differing positions.

Figure 34:
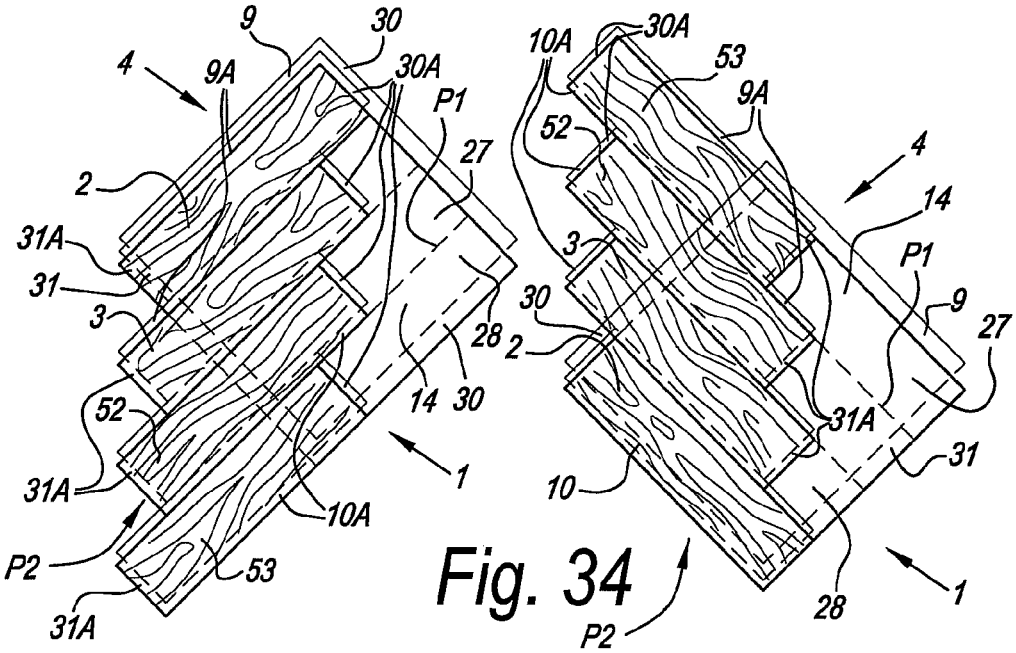
FIGS. 34 to 40 illustrate several particular variants and their application in a floor covering.

FIG. 34 shows two examples of floor elements 1 with the characteristics of the first aspect, wherein an entity 4 is effected by means of four components 2-3-52-53. Here, the entity-forming means 14 relates to a basic structure 28, which extends or can extend at least beneath all components 2-3-52-53. Apart from the depicted mutual positions P2 of the components 2-3-52-53, also mutual positions P1 can be adopted, in which the floor element 1 has a globally rectangular and in this case square shape. In the example, the basic structure 28 as well as the components 2-3-52-53 have coupling means 9-9A-10-10A at two pairs of opposite edges or sides, preferably this relates to coupling means allowing at least a horizontal or a vertical locking, and still better allowing both. It is noted that it is not excluded that solely one of the two, the basic structure 28 or the components 2-3-52-53, have such coupling means. Also, it is not excluded that the coupling means are provided solely at two opposite sides of the basic structure and/or the components. Also, preferably between such floor elements 1 as a whole, by means of the coupling means present thereon, a vertical as well as a horizontal locking with other similar floor elements 1 in the floor covering is obtained.

The difference between both floor elements 1 depicted in FIG. 34 lies in the fact that the coupling means 9A-10A in the second floor element 1, depicted at the right hand side, in comparison to the first floor element 1, depicted at the left hand side, are arranged in mirrored order around the components 2-3-52-53. However, the coupling means 9-10, which are present at the basic structure 28, are arranged in equal order. As is known, for example, from WO 2004/063491, by means of floor elements having a mutually mirrored arrangement of the coupling means, a floor covering with a herringbone pattern can be formed. As seen in WO 2005/098163, this characteristic, however, is no necessary condition for forming a herringbone pattern.

Figure 35:
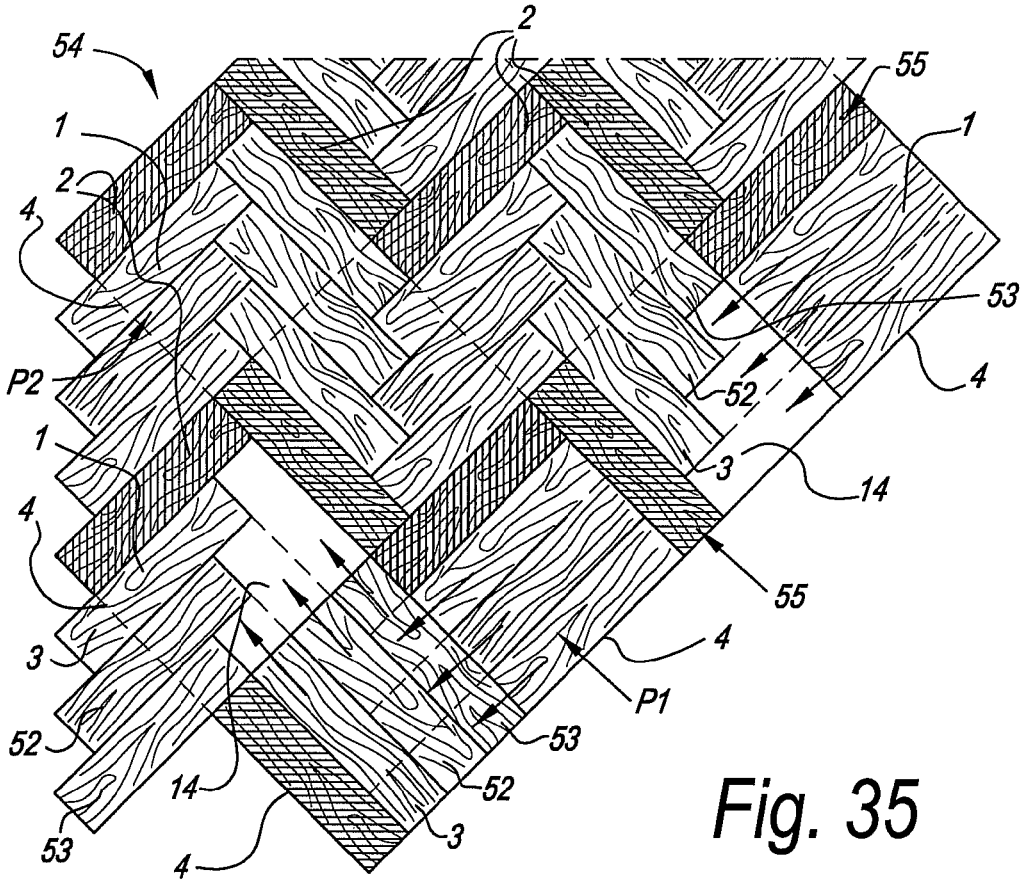
Figure 36:
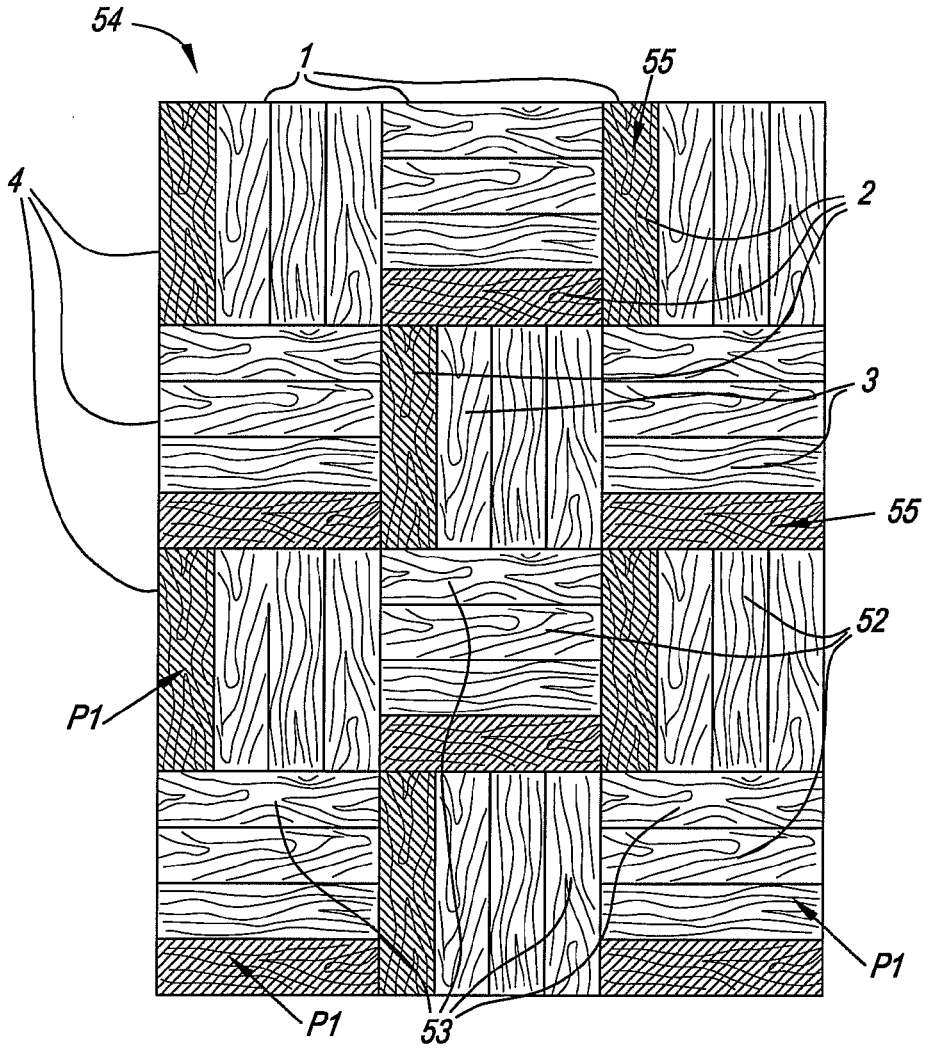

FIG. 35 shows that with the floor elements 1 from FIG. 34, also such floor covering 54 can be formed, and also other patterns, such as the block pattern from FIG. 36, can be formed. This block pattern simply is achieved by applying the components 2-3-52-53 in the mutual position P1, in which the floor elements 1 have a globally rectangular shape, and in this case a square shape.

It is noted that, in the case when at least one of the components 2 is fixedly connected to the basic structure 28, whether by means of a glue or adhesive connection, or by the fact that the respective component 2 is formed at least partially in one piece with the basic structure 28, or by means of mechanical coupling means, or by a combination of the above possibilities, a good connection can be obtained in the floor covering 54 already by means of the coupling means 9-10 of the basic structure 28, as in such case zones 55 of adjacent components may exist, which are mutually connected by means of the coupling means 9-10 of the basic structure 28. These zones 55 are shown in FIG. 35 by means of shaded components 2. Also in the case of a block pattern, shown in FIG. 35, such zones 55 are obtained. In cases where the basic structures 28 at both pairs of opposite sides 5-6-7-8 have coupling means 9-10 allowing to form a horizontal as well as a vertical locking with a similar basic structure 28, the coupling means 9A-10A of the components 2-3-52-53 at one pair or at both pairs of sides 5A-6A-7A-8A can be restricted to coupling means allowing, for example, solely a horizontal, or solely a vertical locking. It is even possible, for example, at the short pair of sides 7A-8A or at the long pair of sides 5A-6A of the components 2-3-52-53, to omit the coupling means 9A-10A. Even when the coupling means 9A-10A of the components 2-3-52-53 are restricted to a minimum, by means of the coupling means 9-10 of the basic structure 28 still a very good floor covering 54 is obtained, as the components 2-3-52-53, which are lying freely on the basic structure 28, are sitting caught between the zones 55, or, in other words, between the components 2, which are fixedly connected to this basic structure 28.

Figure 37:
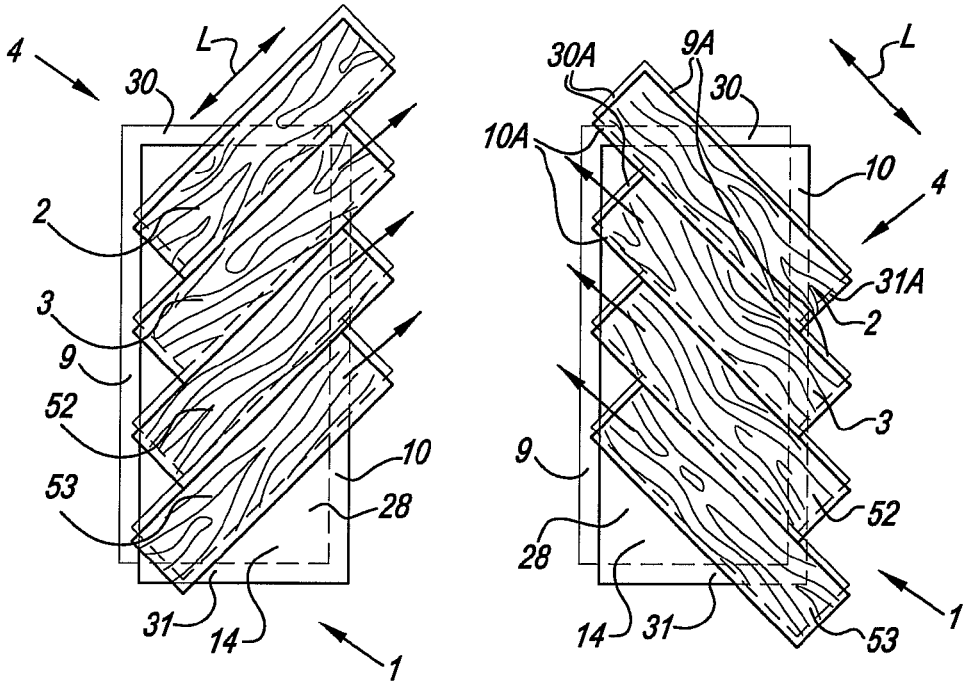

FIG. 37 shows another example of floor elements 1 with the characteristics of the first aspect, which can be applied for forming a floor covering 54 with a herringbone pattern. The particularity of this embodiment is that the components 2-3-52-53 are oriented with their longitudinal direction L not according to the basic structure 28, but form an angle of, in this case, 45 degrees with the main directions of the basic structure 28. This embodiment offers the advantage that a floor covering 54 with a herringbone pattern can be composed by means of such floor elements 1 in a simple manner. By orienting the main directions of the basic structure 28 in respect to the walls of the room in which the floor covering 54 is to be installed, it is obtained that the herringbone pattern, too, is oriented in respect to this walls.

Figure 38:
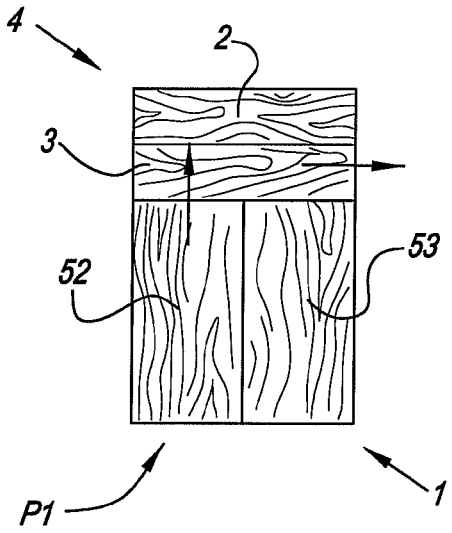
Figure 38:
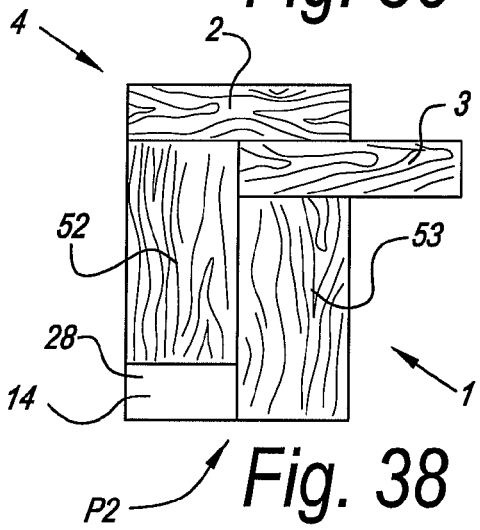
Figure 39:
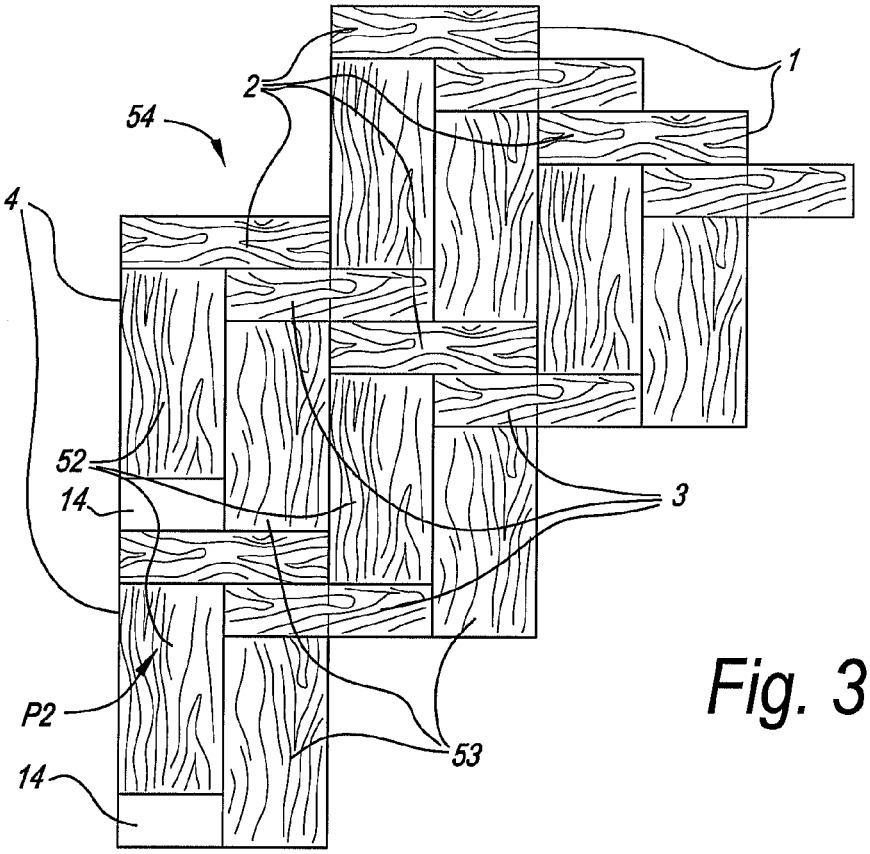

FIG. 38 shows an example, in which also an entity 4 is effected by means of entity-forming means 14, in this case by means of a basic structure 28 or basic board. As clearly seen in the figure, the components 2-3-52 can adopt at least two mutual positions P1-P2. Namely, on the one hand, a first mutual position P1 illustrated by means of the floor element 1 shown at the left hand side in the figure, in which the floor element 1 has a globally rectangular shape, and, on the other hand, at least a second mutual position P2 illustrated by means of the floor element 1 shown at the right hand side in the figure. The floor elements 1 can be applied for composing a floor covering 54 in the mutual position P1 of the components 2-3-52 shown on the left hand side, as well as in the mutual position P1 shown on the right hand side. FIG. 39 represents an example of a floor covering 54, which is composed by means of these floor elements 1. It is clear that herein, use is made of the configuration of the components 2-3-52 shown on the right hand side in FIG. 38.

Figure 40:
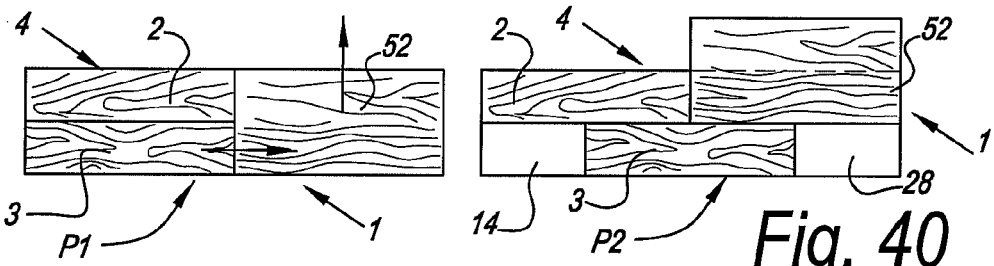

FIG. 40 shows another example of a floor element 1 according to the invention, wherein the components 2-3-51, as indicated by the arrows, can be shifted in longitudinal direction and width direction.

Figure 41:
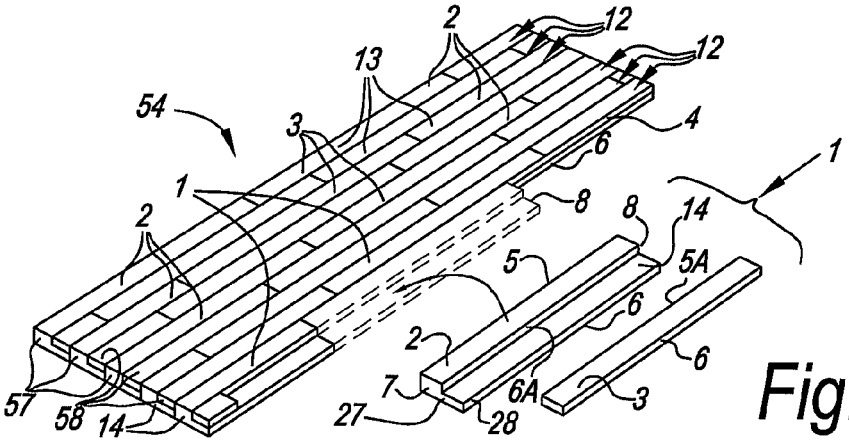
FIGS. 41 and 42 represent different steps in a possible method for composing the floor elements of the invention.

FIG. 41 schematically shows a step in a method for composing floor elements 1 to a floor covering 54. Herein, one starts from floor elements 1, which comprise at least a first component 2 and a second component 3. In the present case, one starts from floor elements 1 of the two-plank type, and by means of entity-forming means 14, in this case, a basic structure 28, which is made in one piece with or is fixedly connected in another manner to a portion of the first component 2, an entity 4 can be effected on the basis of at least said components 2-3. The step in the method, which is represented in FIG. 41, relates to bringing the first component 2 into the plane of the floor covering 54, in this case including the basic structure 28 fixedly connected thereto. This first step preferably also comprises the coupling of the floor elements 1 to floor elements 1 already present in the floor covering 54 by means of mechanical coupling means 9-10, which are present at least at one pair 5-6 and preferably two pairs of opposite edges 5-6-7-8 of the floor elements 1. This coupling may take place in a manner known as such. Thus, to this aim, for example, the installation methods can be applied which are known from DE 29 40 945, WO 94/26999, WO 01/02671, WO 2006/125646, EP 1 282 752.

Figure 42:
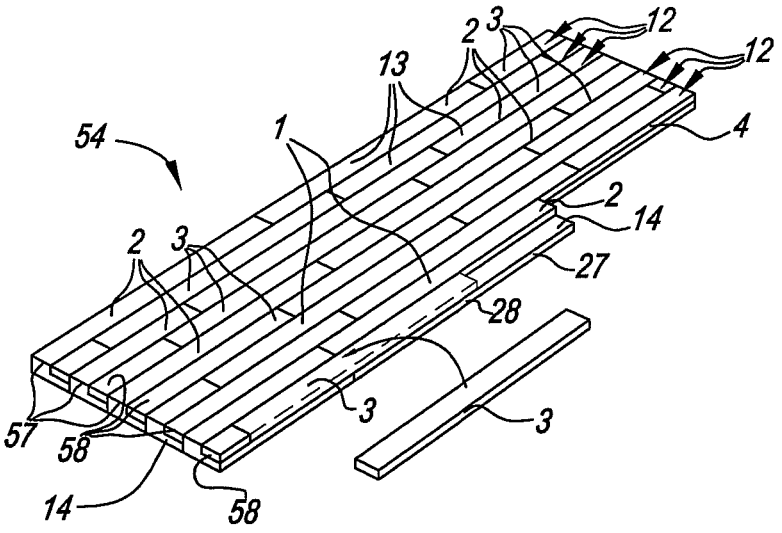

FIG. 42 illustrates a further step in this method, which hereby shows the characteristics of said first possible method. According to the example, this step may consist at least in effecting, starting from a first component 2 and a second component 3, such entity 4 or such floor element 1, and providing the first component 2 as well as the second component 3 in the final position in the floor covering 54. In this case, the respective entity 4 is effected by providing the second component 3 on the basic structure 28 of such floor element 1. It is clear that it is not required that there is an unambiguous relation between the first component 2 and the second component 3. This means, for example, that a first component 2 and a second component 3, which had been packaged together and possibly formed an entity 4 in the package, do not necessarily have to form an entity 4 together in the floor covering 54. In fact, it is possible that they form such entity 4 in their respective final position in the floor covering 54 with other similar first components 2 or second components 3.

It is noted that in the example of FIGS. 40 and 41 the first component 2 already had been brought in its final position in the preceding step described by means of FIG. 41.

Figure 43:
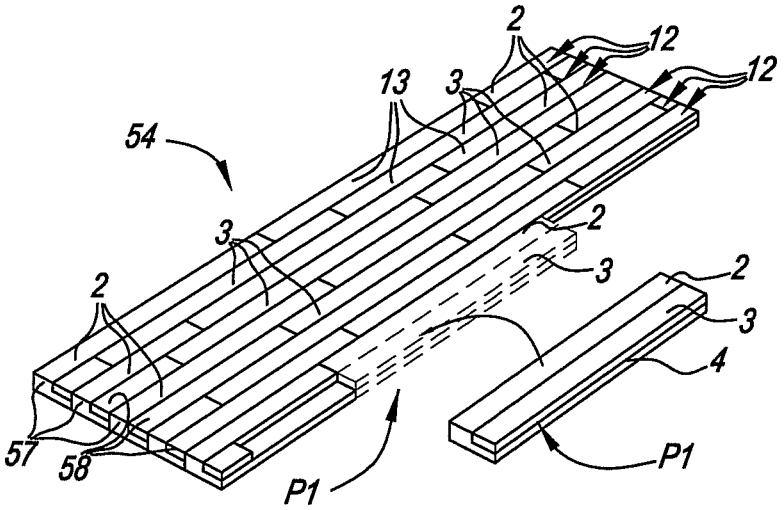
FIGS. 43 and 44 illustrate a variant of such method.
Figure 44:
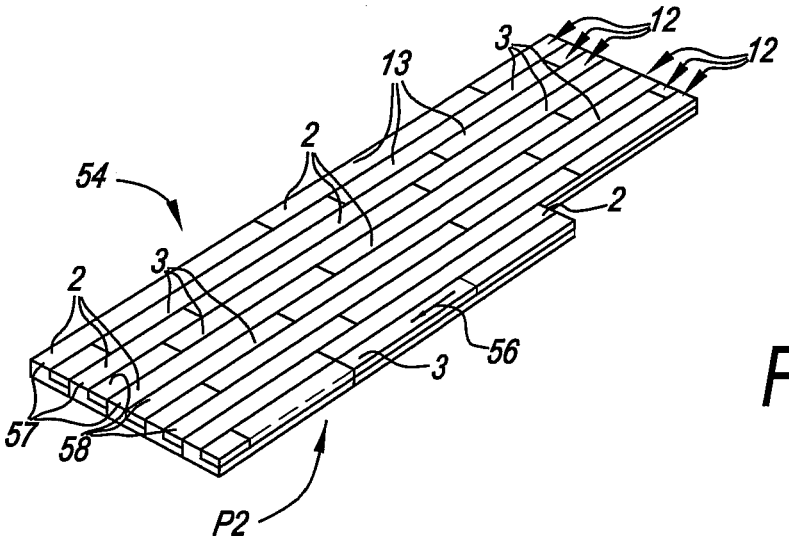

FIGS. 42 and 43 illustrate successive steps in a preferred embodiment of such method. Herein, said first component 2 and second component 3, as illustrated in FIG. 43, are provided as an entity 4, this means, together, in the floor covering 54, after which, as FIG. 44 shows, said entity 4 is changed before they reach their respective positions. In this case, the changing of the entity 4 means a change of the mutual position of the second component 3 in respect to the first component 2. As discussed in the introduction and in the preceding portion of the detailed description, such change of mutual position P1-P2 can be obtained in a variety of manners. To this aim, said entity 4 may be disrupted, whether or not temporarily. A possible alteration is indicated in FIG. 44 by means of the arrow 56 and includes at least a shifting movement along the first component 2. Herein, the second component 3 possibly is in an orientation that is angled in respect to the first component 2. It is noted that, amongst others, in this case the application of a locking system 38 with the characteristics of the fourth and/or the fifth aspect can be applied usefully for coupling together the components 2-3.

Further, it is noted that in the example of FIGS. 40 and 41, as well as in the example of FIGS. 42 and 43 the entity-forming means 14 are active in the respective final positions of the components 2-3 in the floor covering. This means that also in the final floor covering 54 in each case there is an entity 4 between at least a first component 2 and a second component 3.

It is clear that the FIGS. 42 and 43 also illustrate a method with the characteristics of the second possible method mentioned in the introduction. To this aim, at least said first component 2 and said second component 3 are provided in a mutual starting position P1 commonly in the plane of the floor covering 54. Thereafter, the components 2-3 are brought out of this mutual starting position P1 and into their respective final mutual position P2 in the floor covering 54. Herein, said first component 2 in the example reaches its final position earlier than said second component 3.

It is clear that each of said components 2-3 of the floor elements 1, with which the floor covering 54 according to FIGS. 41 to 43 is composed, can be provided with a decorative side 11, which, in the final position of the respective component 2-3 in the floor covering 54, is intended for forming a portion of the floor surface. In such case, such as here, a floor covering 54 can be obtained, which represents rows 12 of decorative parts 13, wherein this floor covering 54 comprises at least a first row 57 of decorative parts 13, which, preferably exclusively, is formed by first components 2, and also comprises at least a second row 58 of decorative parts 13, which, preferably exclusively, is formed by second components 3, wherein said first row 57 and said second row 58 laterally are lying directly next to each other. In the example of the figures, such a first row 57 in each case is alternated with such a second row 58.

Of course it is possible by means of said first and second possible method to obtain also other floor coverings 54, as, for example, the floor coverings illustrated by means of FIGS. 35 and 39. The method is illustrated schematically by means of the arrows in FIG. 35.

In general and with reference to FIG. 1, it is noted that said components 2-3-52-53 preferably have a width B which is significantly larger than the thickness T of the respective component 2-3-52-53. Still better, the width B is larger than two or three times the thickness T of the component 2-3-52-53. A preferred width B is situated, for example, between 5 and 10 centimeters and still better is larger than 6 centimeters.

Figure 45:
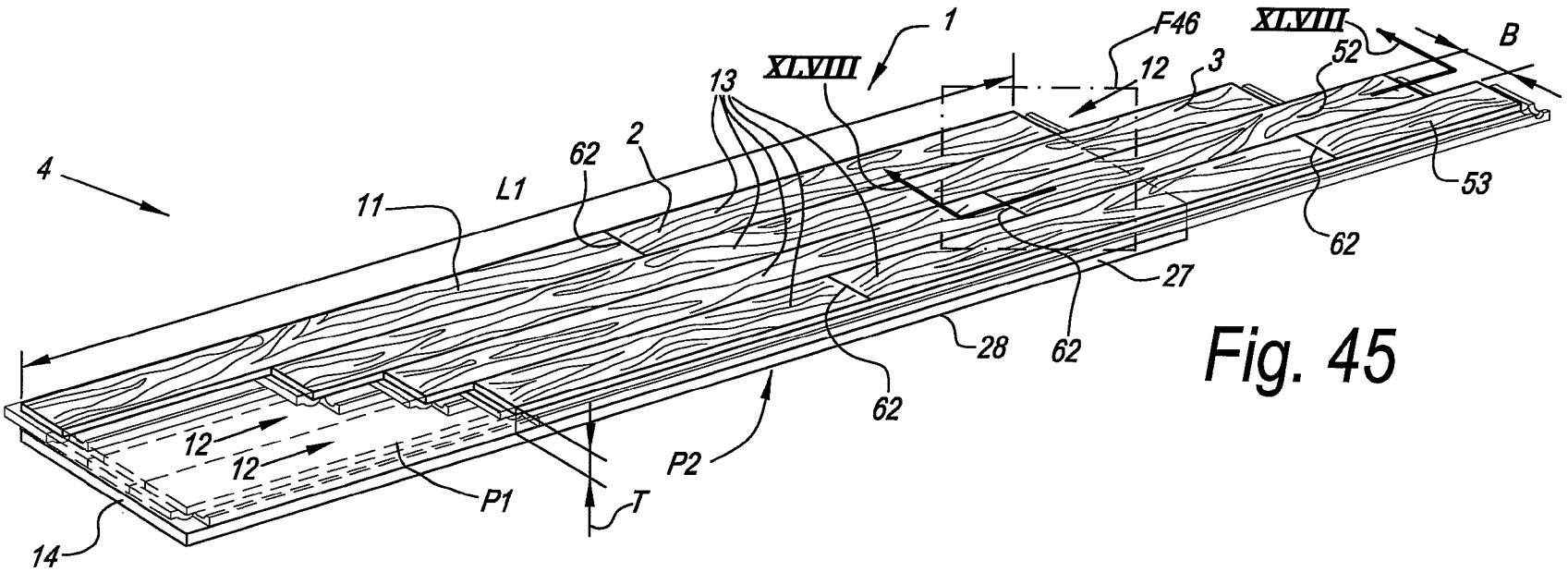
FIGS. 45 to 48 represent further preferred embodiments of a floor element according to the first aspect, wherein FIG. 46 at a larger scale represents a view onto the region indicated by F46 in FIG. 45, and FIGS. 47 and 48, respectively, represent views according to the line XLVII-XLVII represented in FIG. 46 and to the line XLVIII-XLVIII represented in FIG. 45.

FIG. 45 shows an example, wherein the width B of the components 2-3-52-53 is smaller than one tenth, in this case is even smaller than one twentieth of the length L1 of the components, and/or in relation to the length of the possible basic structure 28 has the same width B. In a particularly useful embodiment, the components 2-3-52-53 have a width B between 5 and 8 centimeters, or still better between 6 and 7 centimeters, whereas this component and/or the possible basic structure 28 has a length L1 which is larger than 1 meter and still better is larger than 1.20 meter. Preferably, starting from three or more of these components, an entity 4 is formed, wherein at least one and preferably solely one of these components 2 is fixedly connected to the basic structure 28. In this manner, an optimum relation is obtained between the handling ability of the entity 4 and the dimensions of the components 2-3-52-53, by means of which a floor covering can be composed that is very agreeable to the user. In the example, four components 2-3-52-53 are applied, which each as such may or may not represent a plurality of decorative parts 13. It is clear that the components 2-3-52-53 of the floor elements 1 in the figure, apart from the represented mutual position P2, may adopt also at least one mutual position P1, shown in dashed line, in which the global shape of the floor element is rectangular and oblong. Further, it is clear that the depicted floor element may represent an improvement of a so-called four-plank element.

Figure 46:
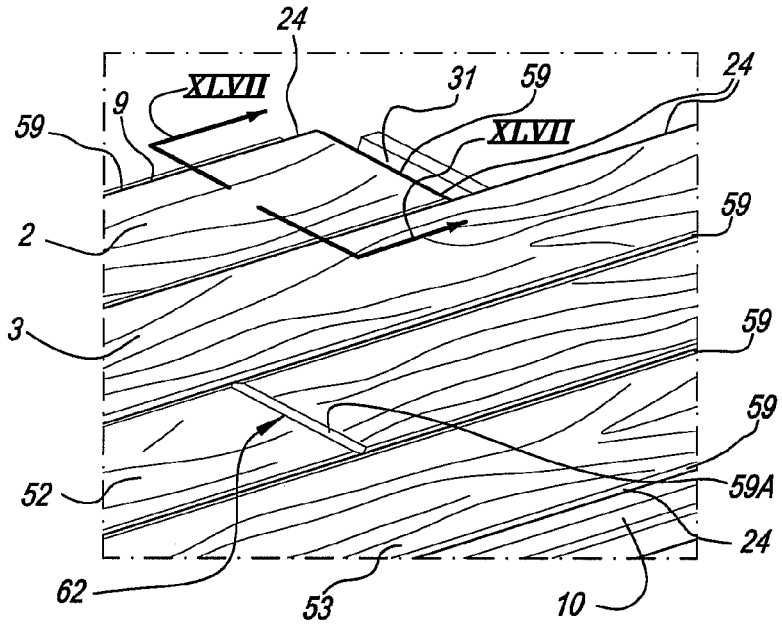

As FIG. 46 shows, the components 2-3-52-53 as such and/or the floor elements 1 may have chamfers 59 or imitation chamfers 59A at one or more upper edges 24. Chamfers 59-59A and methods for providing or for realizing them have become well-known in the meantime for application at various types of floor elements and floor panels. As an example, reference is made to WO 01/96688, where such chamfers for laminate floor panels are introduced.

FIGS. 21, 25 and 26 of the present application show examples of a chamfer 59. In this case, this relates to a chamfer 59 of the upper edges 24 in the shape of a bevel. In the case of components in the form of a laminate panel, chamfers can be applied by a plurality of techniques. For example, they can be solely depicted in the printed decor, they can be formed by the removal of material at the respective upper edge, they can be formed by an impression, and the like. In the case where they are formed by the removal of material at the respective upper edge, preferably a separate decorative layer is provided on the chamfer.

Figure 47:
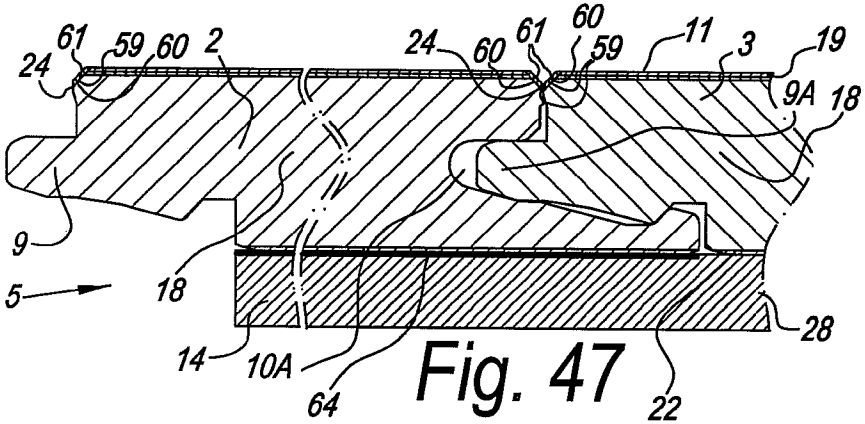

FIG. 47 shows an example, wherein the components 2-3 at the upper edge 24 of at least both sides 5A-6A of a first pair of opposite sides, and preferably, although not shown here, also at the second pair of opposite sides 7A-8A, are provided with a chamfer 59, which is formed by the removal of material. The surface 60 formed thereby extends, as represented, preferably through the top layer 19 and the core material or the core 18 of the respective component 2-3. However, it is not excluded that such chamfer 59 remains restricted to said top layer 19. Although the component represented here is constructed like a laminate panel of the DPL type, it is not excluded that such chamfers 59 are applied at others of said possible top layers 19. This technique may be, for example, particularly useful with top layers consisting of veneer. The surface 60 formed by the removal of the material is provided with a separate decorative layer 61, for example, in the form of a hardened substance, such as lacquer, ink, or the like, or in the form of a print provided by means of transfer printing.

When the decorative sides 11 of the components 2-3, as it is the case, amongst others, in FIGS. 1, 2, 7, 45 and 46, as such represent a row 12 of two or more decorative parts 13, a chamfer 59 or imitation chamfer 59A can also be provided, by means of any technique, on the transition 62 between these decorative parts 13. In the case that the components are constructed as laminate panels, again the herein above-mentioned techniques can be applied.

Figure 48:
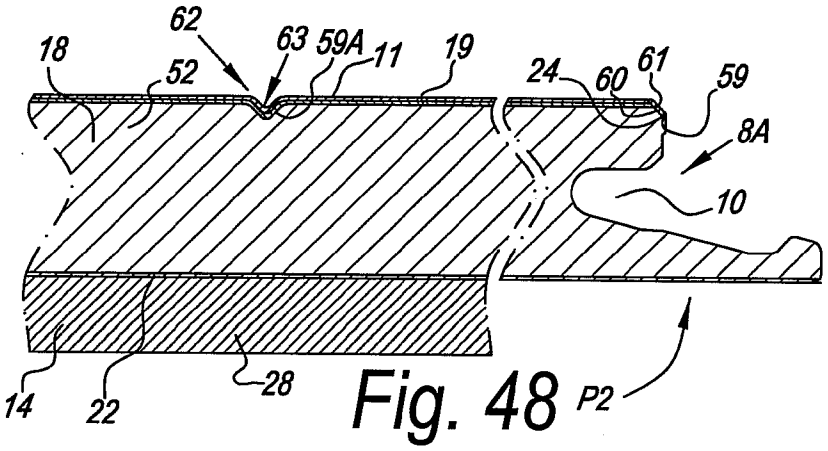

FIG. 48 shows an example, wherein an imitation chamfer 59A is provided on such transition 62 by means of an impression 63 of the top layer 19 and possibly of the underlying core material 18. It is noted that, as is known, amongst others, from WO 2006/066776, a pressing element may be used for providing such impression 63. In the case of a component 2, which is constructed like a laminate panel, the impression 63 can be applied with the pressing element used for forming the top layer 19. It is self-evident that the components 2-3-51-53 may also comprise other recesses in the upper surface or decorative side 11, whether or not in the form of impressions. For example, in the case of components 2-3, which are constructed like laminate panels, techniques for creating impressions imitating a wood structure may be applied. Such techniques are known, for example, from WO 2001/096689 or the above-mentioned WO 2006/066776. Further, FIG. 46 shows that also the short sides 7A-8A of the components 3-52-53 can be provided with a chamfer 59. In the represented example, this relates to a chamfer 59, which has been obtained by the removal of material and the provision of a separate covering 61 on the obtained surface 60.

Generally, it is noted that chamfers 59 or imitation chamfers 59A, due to the fact that an entity 4 is formed starting from components 2-3 with floor elements 1, can be provided in floor elements 1 according to the invention in many respects simpler than in floor elements of the state of the art.

For providing the imitation chamfers 59A and/or the pertaining separate decorative layer 61, automatic techniques may be considered for detecting the transition 62 between the respective decorative parts 13 by means of sensors, such as cameras. By means of this information, the machining or other treatment for forming the imitation chamfer can be controlled such that the imitation chamfer, and possibly the pertaining separate decorative layer 61, can be provided in such manner that it corresponds as well as possible to said transition 62. The forming of the imitation chamfers 59A may be performed possibly simultaneously to, or at least in the same machine as, the forming of the coupling means at the short sides of the respective component. To this aim, an additional entity can be introduced in a typical edge treatment machine, which entity, viewed transversely to the passage direction of the components, is situated between the milling tools shaping the coupling means. Such arrangement may mean an economy of space in a production line for manufacturing the floor elements of the invention.

As already mentioned earlier, in floor elements 1, such as the one depicted in FIGS. 45 to 48, preferably at least one of the components 2 is fixedly connected to the basic structure 28, for example, by means of a glue connection 64, which is represented as an example in FIG. 47 as a piece of a line.

It is noted that in the case that the basic structure consists of a board, for example, as in FIGS. 7-10, 15-16, 20, 31, 34-40 and 45-48, such embodiments also can be defined as being a floor element, with the characteristic that it comprises at least a basic structure formed by a board, as well at least two components which can be coupled together at their edges, which components each consist of a floor panel, of which at least a first component is fixedly attached to the basic board, whereas at least a second of said components is displaceable and thus may adopt various positions in respect to the first component. Of course, the invention thus relates to all embodiments subsumed under this independent portrait definition. It is also evident that the invention also relates to embodiments which fulfill said portrait definition and which further have one or more additional subordinated characteristics, which have been described by means of the above embodiments.

Further, it is noted that there, where a component lying freely on a basic structure is mentioned, by "freely" in these cases is meant that this component 3 can be displaced or shifted in respect to the basic structure 28, and thus possible temporary attachment means, such as a releasable glue connection, between the component 3 and the basic structure 28 are not excluded. Also, it is not excluded that components 3, which can be shifted in respect to a basic structure 28, such as a board, in their final position are fixedly connected to the basic structure, for example, by means of a glue connection.

In respect to the basic structures 28 or basic boards represented in the figures, for example, in FIGS. 15 and 45, it is noted that they are not bound to a certain thickness, but can be made in relation to the components 2-3 thicker as well as thinner than represented.

Figure 49:
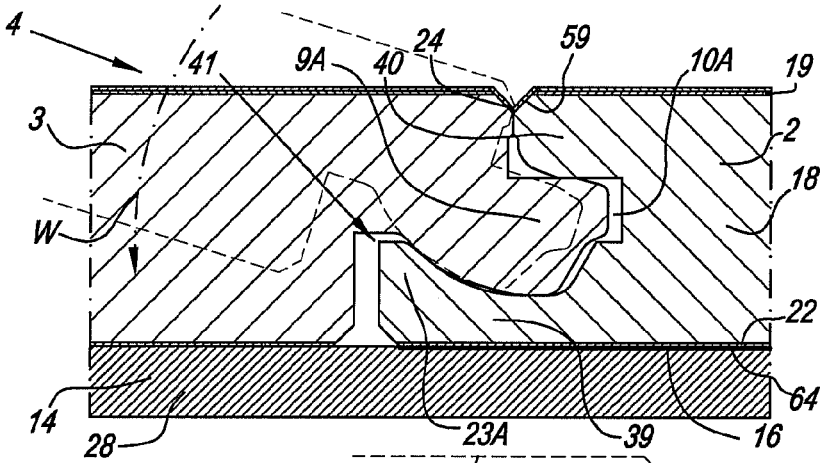
FIGS. 49 and 50 in cross-section represent still more locking systems which can be applied in a floor element according to the invention.

FIG. 49 represents another possible locking system which can be applied, for example, at the sides, in particular at the long sides 5-6, of the components of a floor element 1 of the invention. In particular, the represented coupling means are suitable for being applied at the long sides 5-6 of floor elements 1 of the type as represented in FIG. 45. The coupling means substantially consist of a tongue 9A and a groove 10A, which are provided with locking means 41, such that, when coupling two floor elements 1 or the components 2-3 thereof, a horizontal as well as a vertical locking between the respective sides of the floor elements or components is created. The coupling means 41 represented here allow that the tongue 9A can be brought at least by an angling movement W around the upper edges 24 into the groove 10A. In the represented case, such angling movement W is the only movement by which the coupling means can be engaged into each other. In dashed line, it is shown that the tongue panel 3 must be angled relatively high upward before the connection is entirely disrupted, which allows to shift a tongue panel 3, which has been angled upward to some degree, in the longitudinal direction L of the groove 10A along the respective sides without the connection being completely disrupted. It is self-evident that this feature is particularly interesting for obtaining a smooth installation of the components 2-3 in the floor elements 1 of the present invention according to some preferred embodiments thereof.

A particular, not represented variant of a floor element according to the first aspect of the invention relates to a floor element, wherein at least one of the aforementioned components as such is composed of a plurality of elements. In the example of FIG. 1, 7 or 45, it might be possible, for example, that a component 2, which represents a row 12 of decorative parts 13, is composed of elements, which each as such represent, for example, solely one decorative part. These elements may be connected to each other, whether or not releasably, for forming the respective component. For example, they may be connected, preferably in a releasable manner, by means of mechanical coupling means effecting a vertical as well as a horizontal locking among the elements. Such coupling means can be of the type as represented in FIGS. 3 to 6. Preferably, such elements will have a mutually differing length or have a differing length in comparison to other elements intended to be taken up in the same floor covering. For example, it can be worked with three different lengths. From EP 1 437 456, it is known that various advantages may be obtained by decorative parts of different lengths.

According to another, not represented variant of the first aspect of the invention, the components of one and the same floor element comprise at least one pair of coupling means allowing for a coupling in horizontal and vertical direction by means of a downward movement. Such coupling is known better as a "pushlock" and is known as such, for example, from WO 00/47841.

Figure 50:
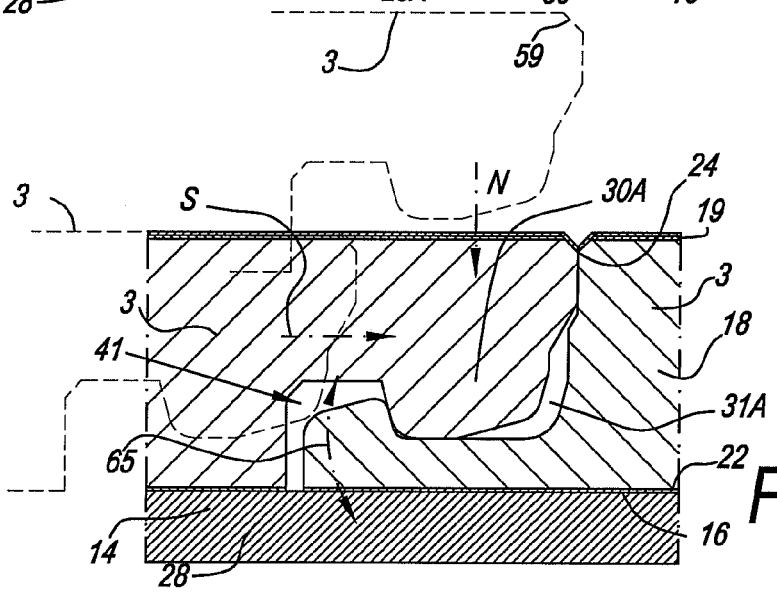

Still another variant is represented in FIG. 50. In this example, the components 2-3 of the same floor element 1 comprise at least one pair of coupling means allowing a coupling in horizontal direction H1 by means of a downward movement N, without any vertical connection. Such coupling is known better as a "drop" connection and, in the floor elements 1 of the present invention, preferably can be applied to the short sides 7A-8A of the components 2-3. The example of such drop connection represented here also has the particular feature that the male coupling part 30A can be provided in the female coupling part 31A not only with a downward movement N, but also with a substantially horizontal shifting movement S. This feature allows that the components 2-3, preferably at their short sides 7A-8A, can be engaged into each other in a simple manner even at difficult to reach places, such as beneath overhanging cabinets and radiators. Preferably, in such case the respective component 2-3 is guided at its long sides 5-6 in that it is already connected with adjacent components 2-3.

FIG. 50 also shows by means of the arrow 65 that preferably at least when performing said horizontal shifting movement S an elastic deformation of the female coupling part 31A occurs. It is not excluded that in the coupled condition of the male coupling part 30A and the female coupling part 31A there is still a bending-out of the respective portion of the female coupling part 31A.

Figure 51:
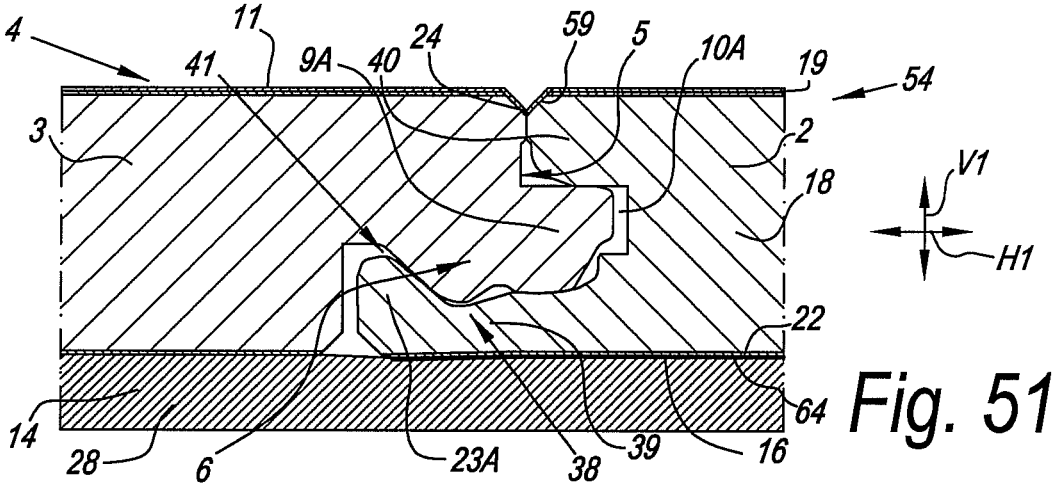
FIGS. 51 and 52 in the same view represent variants of the locking systems of FIGS. 49 and 50, respectively.

FIG. 51 represents another possible locking system 38 which can be applied in the same circumstances as the locking system from FIG. 49, for example, at the long sides 5-6 of the components 2-3 of a floor element 1 according to the invention, and to this aim also is constructed substantially similar to this locking system from FIG. 49. The particularity of the locking system 38 shown here lies in the fact that in a coupled condition of the components 2-3 the lower lip 39 of the groove 10 adopts a bent position, in which it actively counteracts the occurrence of gaps at the upper edges 24 of the components 2-3 by means of its elastic resilience. Locking systems 38 having in coupled condition a bent groove lip 39 are as such better known as locking systems with so-called "pretension". The principle of pretension in floor elements is known as such, for example, from WO 97/47834. FIG. 51 clearly shows that it is possible that the basic structure 28 is made of a compressible material, which can offer space for the bending-out of the lower lip 39.

Figure 52:
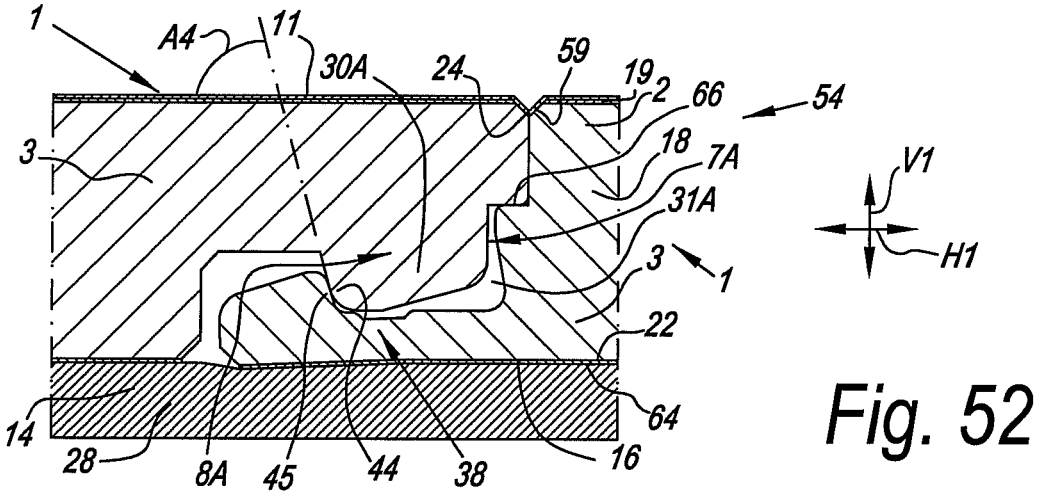

FIG. 52 shows another locking system 38, which is constructed similar to that of FIG. 50 and which, as the locking system 38 of FIG. 50, preferably is applied at the short sides 7A-8A of the components 3 of the floor elements 1 of the present invention, however, can also be applied in other floor elements 1. The particular characteristics of the locking system 38 represented here relate to, on the one hand, the presence of so-called "pretension" and, on the other hand, the presence of a vertically active support surface 66 by which, despite a bendable female coupling part 31A, it can be avoided that the male coupling part 30A moves too far downward when the surface or decorative side 11 of the floor covering 54 is loaded. By means of this latter characteristic, a stable floor covering 54 can be obtained, wherein the risk that the female coupling part 34A fails can be limited. It is clear that the vertical position of said support surface 66 preferably is little or not at all influenced by a possible bending of the female coupling part 31A. Also, it is clear that both aforementioned particular characteristics also can be separately present in the locking system 38. When they are combined, as represented here, one will work preferably with relatively straight horizontally active locking surfaces 44-45 between the male coupling part 30A and the female coupling part 31A. In particular, one can work with locking surfaces 44-45 forming an angle A4 of more than 70° and even more than 80° with the upper side or decorative side 11 of the respective floor element 1 or component 3. Hereby, it is obtained that the elastic resilience of the female coupling part 31A has only a small or even practically no vertical effect on the female coupling part 30A, such that the risk of the creation of height differences between the respective components 3 or floor elements 1 is minimized; on the contrary, it is obtained that this resilience substantially results in a pretension force by which the components 3 or floor elements 1 are actively forced towards each other in horizontal direction H1.

It is noted that the coupling means which are represented in FIGS. 50 and 52 may also been applied in other floor elements 1 than in floor elements 1 showing the characteristics of the first aspect and/or said portrait definition. They can be applied particularly beneficial in narrow panels, such as laminate panels, for example, in panels with a width B that is smaller than 16 centimeters, preferably is smaller than 10 or is even smaller than 8 centimeters. It is clear that the coupling means represented in FIGS. 50 and 52 form a locking system with the characteristics of the sixth aspect of the invention mentioned in the introduction.

Figure 53:
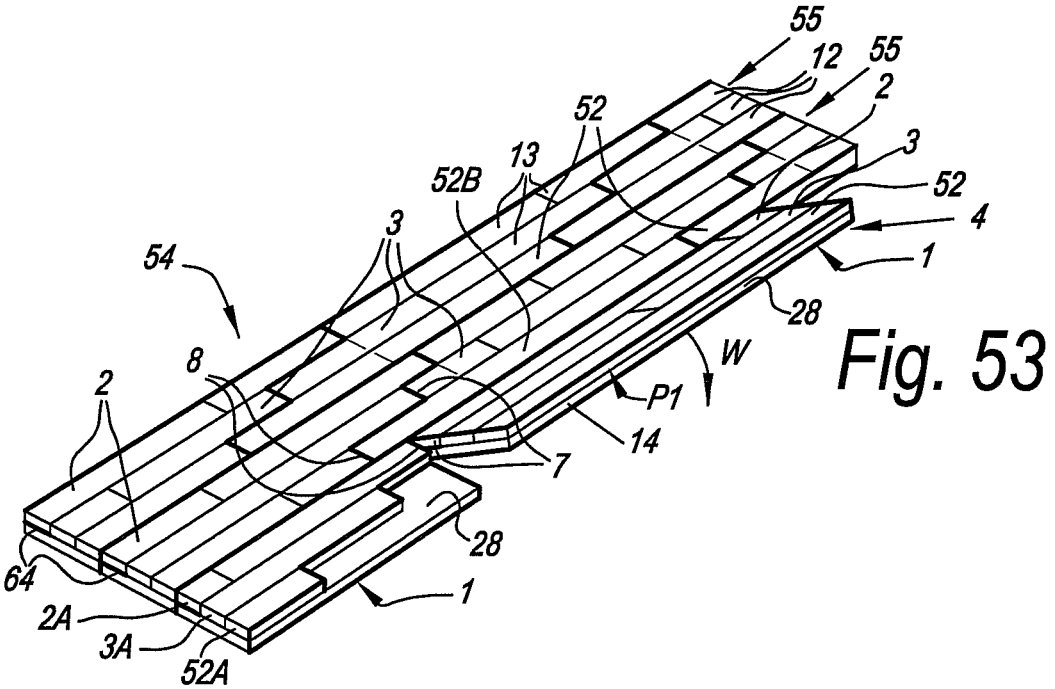
FIGS. 53 to 60 represent various steps in possible methods for composing the floor elements of the invention, wherein FIGS. 55 and 57 in cross-section represent a view respectively according to the line LV-LV indicated in FIG. 54 and the line LVII-LVII indicated in FIG. 56, and FIG. 58, in a view similar to that of FIG. 57, represents a variant.

FIG. 53 represents a step in a method for composing a floor covering 54 by means of floor elements 1 with the characteristics of the first aspect and/or of said portrait definition. FIG. 53 clearly shows that the components 2-3-52, in this case, three components 2-3-52, which are provided on a common basic structure 28, are situated in a mutual starting position P1, in which the floor element 1 of the example adopts a substantially rectangular shape. The components 2-3-52 can be provided in this mutual starting position P1, for example, as represented, by means of an angling movement W in the plane of the floor covering 54.

Figure 54:
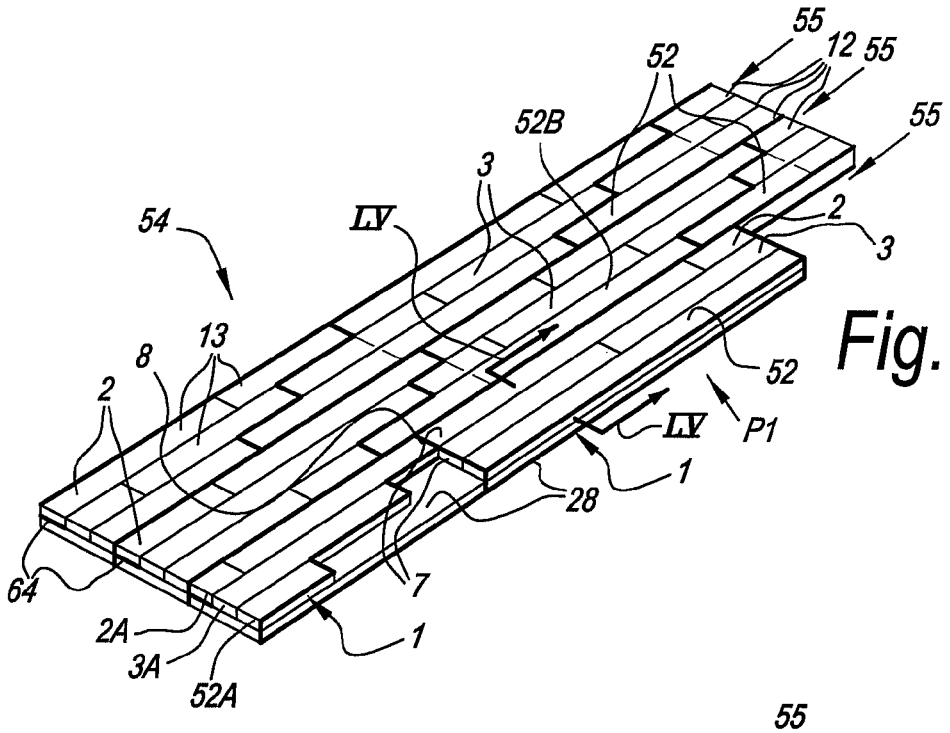

FIG. 54 represents the obtained condition, wherein said basic structure 28 or board as well as the components 2-3-52 are situated in a common plane with the other basic structures 28, components 2-3-52, respectively, present in the floor covering 54. As represented, the mutual starting position P1 has substantially been maintained in the obtained angled-down condition.

Figure 55:
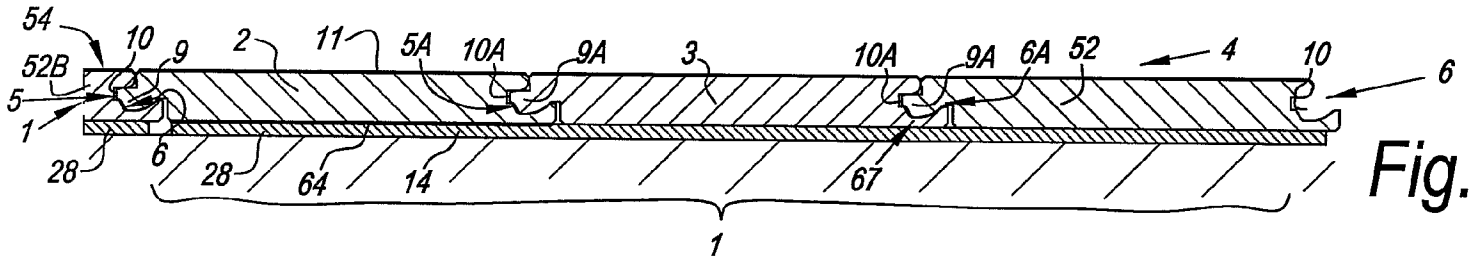

FIG. 55 illustrates that the respective components 2-3-52, at opposite long sides 5-6, are provided with coupling means 9-10-9A-10A allowing to form a locking in horizontal direction H1 and vertical direction V1 with a similar component 2, more particularly are provided with coupling means 9-10-9A-10A similar to those represented in FIGS. 49 and 51. In the angled-down condition, such locking in horizontal direction H1 and vertical direction V1 has been effected between the long side 5 of one of the components, namely, in this case the component 2 which is fixedly attached on the basic structure 28, and a long side 6 of a component 52B already present in the floor covering.

Of course, it is possible, and moreover preferred, that the respective components 2-3-52 also are provided with coupling means at opposite short sides 7-8. Herein, this preferably relates to coupling means allowing at least a locking by means of a downward movement N, such as those represented in FIGS. 50 and 52, or as it is the case in a so-called "pushlock" coupling. In the downward-angled condition, a locking can also be obtained at the short sides 7-8 by means of a component 2A already present in the floor covering 54, such that the respective component 2 can adopt its final position in the floor covering 54 by means of the angling movement W represented in FIG. 53. The remaining components 3-52 then can be brought into their final position, starting from the obtained angled-down position, by means of a shifting movement S performed in an either inclined or not inclined position P2. It is not excluded that for the installation of one and the same component 2-3-52, one alternates between inclined and not inclined positions. So, for example, may a certain component 3 be shifted in an inclined position P2 and thereafter be shifted in the not-inclined position or vice versa. For example, it may be useful to bridge-over the largest distance in the inclined condition P2 and afterwards effect the final connection at the short sides 7-8 by means of a short horizontal shifting movement, for example, with the aid of a hammer and a tapping block.

Figure 56:
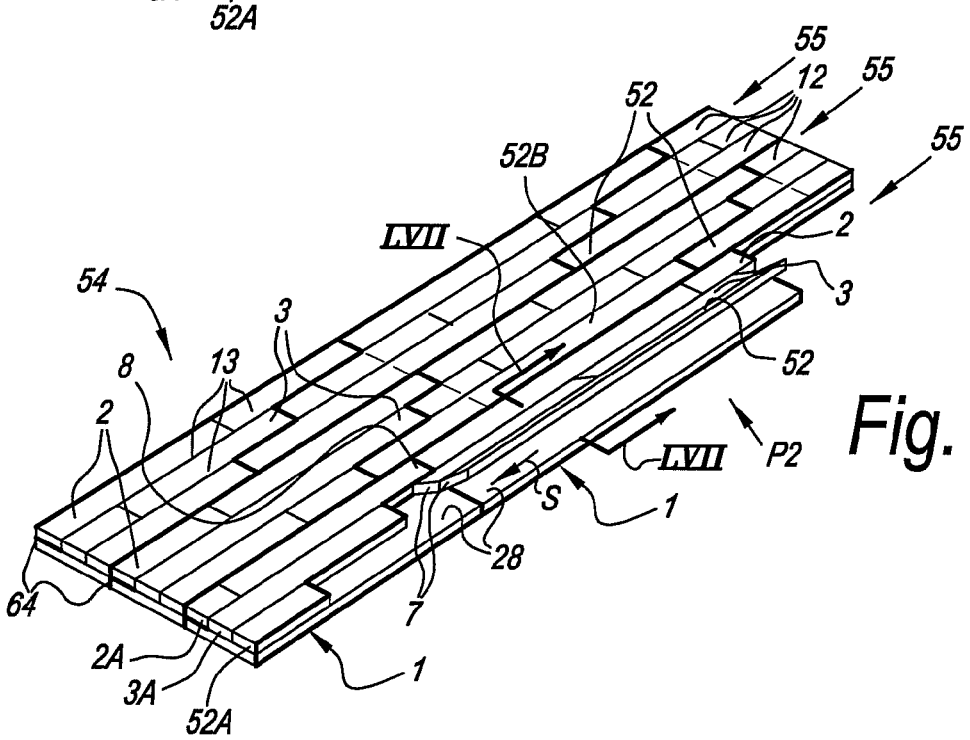

FIG. 56 represents a possibility in which the remaining components 3-52 are shifted in an inclined position P2. This possibility can be applied in an advantageous manner when the coupling means at the long sides 5-6 of the components 2-3-52 show a certain tension, such as pretension, in the completely connected condition thereof and therefore are more difficult to shift, and/or when one wishes to connect the short sides 7-8 by means of a downward movement N. It is evident that such tension or pretension can diminish or disappear when the components 3-52 are angled upward. To this end, reference is made, in a non-restrictive manner, to the locking systems 38 of the fourth and the fifth aspect.

Figure 57:
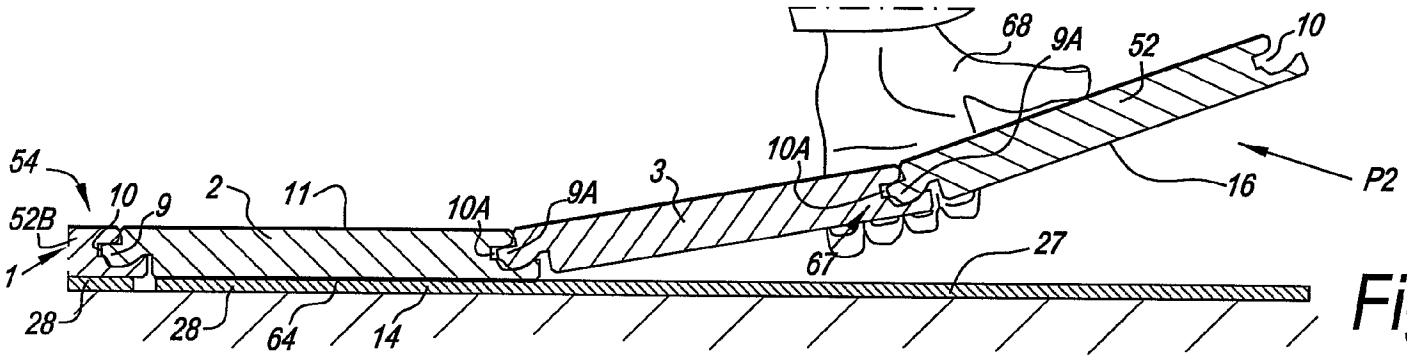

FIG. 57 shows that the components 3-52 can be lifted at their short extremities 7-8 in order to angle them upward together, wherein preferably, such as here, the connection 67 between both angled components 3-52 is supported with the hand 68, or possibly with both hands, such that the risk is minimized that this connection 67 is released completely.

Figure 58:
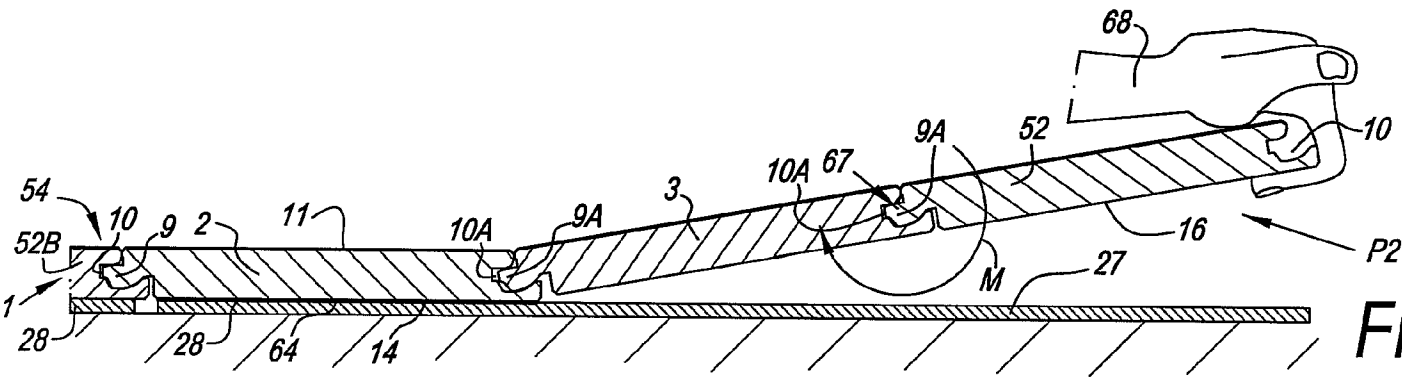

FIG. 58 shows that according to a variant the outer component 52 can be lifted with the hand 68, or possibly with both hands, wherein then preferably a momentum M is exerted onto the connection 67 between both angled components 3-52, such that the risk is minimized that this connection 67 is released completely.

It is noted that a possible partial disruption of the connection 67, wherein the respective components 3-52 during angling-up adopt a mutually inclined position, is not excluded. Such situation is illustrated in FIG. 57. It is clear that the components 3-52 instead of by hand possibly also can be held in their inclined position by means of wedges or other auxiliary tools, wherein these auxiliary tools then preferably also support the connection 67.

In the positions shown in FIGS. 57 and 58, then both components 3-52 can be shifted, whether or not together. It is clear that the figures represent the most preferred embodiment for composing such floor covering 54, however, that it is not excluded that the components 3-52, instead of by an at least partially common shifting movement S, can be brought into their final position by an entirely separate shifting movement.

It is possible that, contrary to what is represented in FIG. 54, the mutual starting position P1 has not been maintained after angling-down, but that the components 3-52 in the angled-down condition adopt, for example, a whether or not desired mutually shifted and/or inclined position. This can be realized on purpose by already angling-up said remaining components 3-52 and possibly shifting them, before the condition represented in FIG. 54 is reached.

Figure 59:
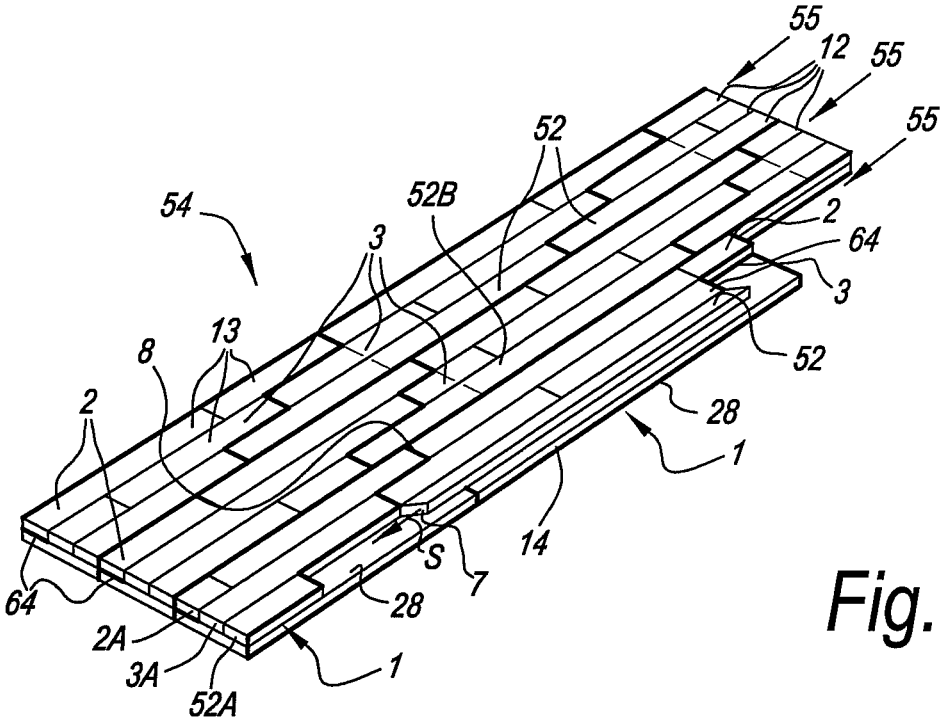

FIG. 59 shows that said common shifting movement S is performed until one of both said remaining components 3 approaches a component 3A already provided in the floor covering 54 and is angled down at that location. Preferably, by means of this angling movement a connection with the floor covering 54 is obtained at the short side 7 of the component 2, more particularly with the short side 8 of the approached component 3A. As already mentioned above, it is not excluded that a relatively short horizontal shifting movement must be performed in order to connect the short side 7. In case that the short sides 7-8 are provided with coupling means, such as those of FIG. 50 or 52, more particularly coupling means allowing a coupling by means of a horizontal shifting movement as well as by means of a downward movement, both possibilities can be applied.

Figure 60:
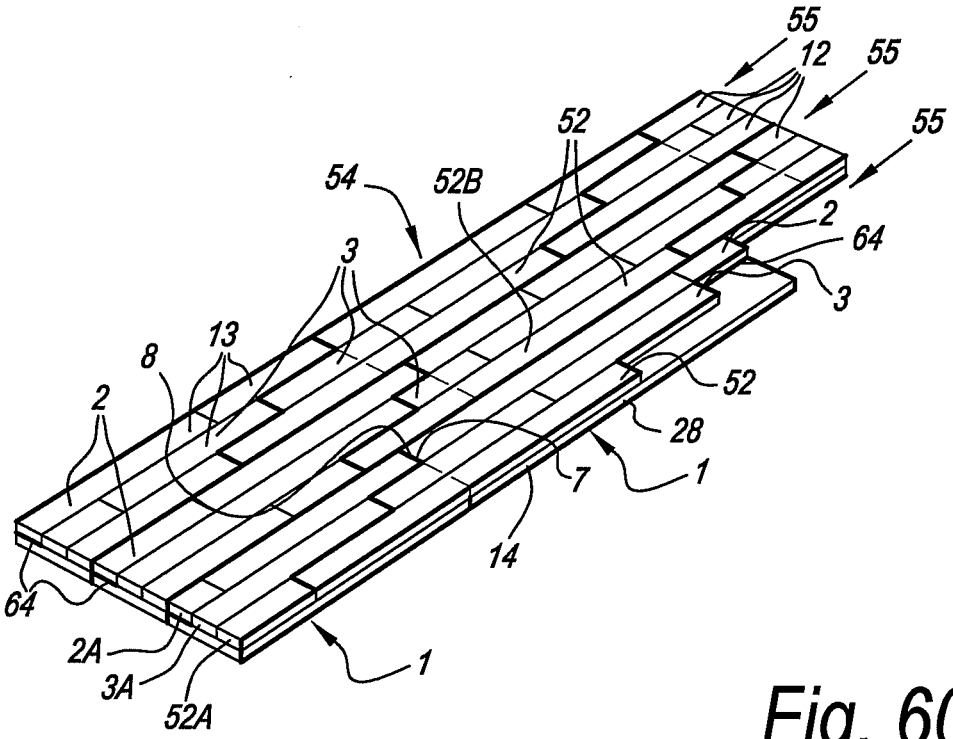

FIG. 60 finally shows that the third component 52 then as such can be shifted in an inclined position and can be connected to the floor covering 54 in the same manner. It is clear that it is not excluded that the component 52, when angling-down the component 3, also is angled down and then angled up again in order to bring it into the position of FIG. 59. Further, it is possible that first the component 52 is brought into its final position, wherein the component 3 then preferably is brought into its final position by means of a horizontal shifting movement.

It is clear that, when further components, such as a fourth component 53, are situated on the basic structure 28, those can be connected in a similar manner. Also, it is clear that for performing the method represented in the FIGS. 53 to 60 it is not necessary to make use of components 2-3-52 which are provided on a common basic structure 28, nor of floor elements fulfilling the characteristics of the first aspect or of said portrait definition. So, for example, it may also be applied for composing floor elements which, in their mutual starting position, consist of floor panels known as such, which are coupled together at one pair of opposite sides, without referring to entity-forming means. Principally, such method implicates that two or more floor panels together are handled by the user for composing the floor covering 54. Preferably, in such case this relates to narrow floor panels having preferably a width of less than 16 centimeters, and still better of less than 10 centimeters or even less than 8 centimeters. When the method is performed with such floor panels or components, it may offer an optimum economy of time.

Further, it is clear that the method illustrated by means of FIGS. 53 to 60 shows the characteristics of said first and second possibility, in other words, of said second and third aspect.

It is clear that in the case that the short sides 7-8 of the components 2-3-52 are provided with coupling means allowing a coupling by a downward movement as well as a coupling by a substantially horizontal shifting movement, in each case the shifting of the components can be chosen during the installation of the floor elements 1 and possibly may be alternated between the inclined or not inclined position.

According to not represented variants of the invention, marks may be provided on the components, more particularly on the coupling means, and/or on the entity-forming means, for example, on a possible basic board or basic layer. For example, this may relate to marks giving the user some directions for the extent in which the components can be displaced. Possibly, also trade names or usage instructions can be provided on a possible basic board or basic layer. It is also possible that the package or a portion thereof may be applied as a template for indicating the extent to which the components can be shifted.

It is also noted that when manufacturing the floor elements of the invention, more particularly when manufacturing the floor elements having the characteristics of the portrait definition, automatic devices possibly can be applied for connecting the components of one and the same floor element by means of the coupling means. In the case of oblong components, this preferably relates to coupling together the long sides of these components by means of the mechanical coupling means present thereon. By means of such device, packages of in each case two or more components can be coupled, wherein the basic layer, basic board or basic structure then can be attached to the underside of one of more components of this package, for example, can be glued thereto. In this manner, entities with the characteristics of the invention can be obtained. It is also possible to automatically couple the components together, while already one or more components are fixedly attached to the basic structure. In case that the coupling means at the long sides of the components allow a connection by means of an angling movement, a rotary system may be applied for automatic coupling. For example, a rotary drum with a polygonal cross-section may be applied, wherein components are applied against the outer sides of these drum, for example, by suctioning them against the respective side, and wherein the components, after a certain rotation of the drum, are removed therefrom, more particularly rolled off therefrom, while gradually performing a connection with a panel that already has been rolled off. In case the coupling means at the long sides of the components allow a connection by means of a horizontal shifting movement or a so-called snap coupling, it is also possible to work with to-and-fro translation movements for connecting the respective coupling means.

The present invention is in no way limited to the embodiments described by way of example and represented in the figures, on the contrary may such floor elements be realized according to various variants and such methods can also be performed according to various variants without leaving the scope of the invention.

The invention claimed is:

1. Floor element having a rectangular and oblong shape defined by a pair of long opposite edges and a pair of short opposite edges; said floor element comprising a core and a top layer provided thereon;

said top layer being vinyl based and comprising a printed decor;

long side coupling parts positioned on said pair of long opposite edges;

said long side coupling parts comprising a tongue at one of said long side edges and a groove at the other of said long side edges;

said long side coupling parts allowing two of such floor elements to be coupled to each other by bringing said tongue into said groove by means of an angling movement around their respective edges, wherein in a coupled condition of said long side coupling parts the respective edges are locked to each other in a vertical direction perpendicular to a plane of the coupled floor elements as well in a horizontal direction in the plane and perpendicular to the respective edges of the floor elements, said plane defined by the respective top layers of two coupled floor elements, wherein said long side coupling parts allow adoption of at least a first mutual orientation and a second mutual orientation between two said floor elements, wherein in the first mutual orientation the top layer of each of said two such floor elements are situated substantially in the same plane, and in the second mutual orientation the top layer of each of said two such floor elements enclose an angle (A2) of 170 degrees or less, and wherein said floor elements in said first mutual orientation as well as in said second mutual orientation are locked together in said vertical direction and said horizontal direction;

short side coupling parts positioned on said pair of short opposite edges;

said short side coupling parts comprising a male coupling part at one of said short opposite edges and a female coupling part at the other of said short opposite edges;

said short side coupling parts allowing two of such floor elements to be coupled to each other by providing said male coupling part with a substantially downward movement in said female coupling part, wherein in a coupled condition of said short side coupling parts the respective edges are locked to each other at least in a horizontal direction perpendicular to the respective edges and in the plane of the floor elements, and wherein said male coupling part includes a distal face extending essentially downwardly and inwardly.

2. The floor element of claim 1, wherein in said coupled condition of said short side coupling parts the respective edges are further locked to each other in a vertical direction perpendicular to the plane of coupled floor elements.

3. The floor element of claim 1, wherein said short side coupling parts are free from locking means effecting in said coupled condition a locking in a vertical direction perpendicular to the plane of coupled floor elements.

4. The floor element of claim 1, wherein said short side coupling parts in said coupled condition comprise interacting horizontally active locking surfaces extending at an angle of about 70 degrees or more with said plane of coupled panels.

5. The floor element of claim 1, wherein said female coupling part comprises a resiliently bendable portion.

6. The floor element of claim 1, wherein said short side coupling parts in said coupled condition comprise interacting vertically active support surfaces extending generally parallel to said plane of coupled panels.

7. The floor element of claim 1, wherein said floor elements have a width of about 16 centimeters or less.

8. The floor element of claim 1, wherein said long side coupling parts in said coupled condition allow for a shifting alongside the respective coupled edges.

9. Floor element having a rectangular and oblong shape defined by a pair of long opposite edges and a pair of short opposite edges; said floor element comprising a core and a top layer provided thereon;

said top layer being vinyl based and comprising a printed decor; said top layer at least at said pair of long opposite edges comprising a chamfer;

long side coupling parts positioned on said pair of long opposite edges;

said long side coupling parts comprising a tongue at one of said long side edges and a groove at the other of said long side edges;

said long side coupling parts allowing two of such floor elements to be coupled to each other by bringing said tongue into said groove by means of an angling movement around their respective edges, wherein in a coupled condition of said long side coupling parts the respective edges are locked to each other in a vertical direction perpendicular to a plane of the coupled floor elements as well in a horizontal direction in the plane and perpendicular to the respective edges of the floor elements, said plane defined by the respective top layers of two coupled floor elements, wherein said long side coupling parts allow adoption of at least a first mutual orientation and a second mutual orientation between two said floor elements, wherein in the first mutual orientation the top layer of each of said two such floor elements are situated substantially in the same plane, and in the second mutual orientation the top layer of each of said two such floor elements enclose an angle (A2) of 170 degrees or less, and wherein said floor elements in said first mutual orientation as well as in said second mutual orientation are locked together in said vertical direction and said horizontal direction;

short side coupling parts positioned on said pair of short opposite edges;

said short side coupling parts comprising a male coupling part at one of said short opposite edges and a female coupling part at the other of said short opposite edges;

said short side coupling parts allowing two of such floor elements to be coupled to each other by providing said male coupling part with a substantially downward movement in said female coupling part, wherein in a coupled condition of said short side coupling parts the respective edges are locked to each other at least in a horizontal direction perpendicular to the respective edges and in the plane of the floor elements, and wherein said male coupling part includes a distal face extending essentially downwardly and inwardly.

10. The floor element of claim 9, wherein in said coupled condition of said short side coupling parts the respective edges are further locked to each other in a vertical direction perpendicular to the plane of coupled floor elements.

11. The floor element of claim 9, wherein said short side coupling parts are free from locking means effecting in said coupled condition a locking in a vertical direction perpendicular to the plane of coupled floor elements.

12. The floor element of claim 9, wherein said short side coupling parts in said coupled condition comprise interacting horizontally active locking surfaces extending at an angle of about 70 degrees or more with said plane of coupled panels.

13. The floor element of claim 9, wherein said female coupling part comprises a resiliently bendable portion.

14. The floor element of claim 9, wherein said short side coupling parts in said coupled condition comprise interacting vertically active support surfaces extending generally parallel to said plane of coupled panels.

15. The floor element of claim 9, wherein said floor elements have a width of about 16 centimeters or less.

16. The floor element of claim 9, wherein said long side coupling parts in said coupled condition allow for a shifting alongside the respective coupled edges.

17. Floor element having a rectangular and oblong shape defined by a pair of long opposite edges and a pair of short opposite edges; said floor element comprising a core and a top layer provided thereon;

long side coupling parts positioned on said pair of long opposite edges;

said long side coupling parts comprising a tongue at one of said long side edges and a groove at the other of said long side edges;

said long side coupling parts allowing two of such floor elements to be coupled to each other by bringing said tongue into said groove by means of an angling movement around their respective edges, wherein in a coupled condition of said long side coupling parts the respective edges are locked to each other in a vertical direction perpendicular to a plane of the coupled floor elements as well in a horizontal direction in the plane and perpendicular to the respective edges of the floor elements, said plane defined by the respective top layers of two coupled floor elements, wherein said long side coupling parts allow adoption of at least a first mutual orientation and a second mutual orientation between two said floor elements, wherein in the first mutual orientation the top layer of each of said two such floor elements are situated substantially in the same plane, and in the second mutual orientation the top layer of each of said two such floor elements enclose an angle (A2) of 170 degrees or less, and wherein said floor elements in said first mutual orientation as well as in said second mutual orientation are locked together in said vertical direction and said horizontal direction;

short side coupling parts positioned on said pair of short opposite edges;

said short side coupling parts comprising a male coupling part at one of said short opposite edges and a female coupling part at the other of said short opposite edges;

said short side coupling parts allowing two of such floor elements to be coupled to each other by providing said male coupling part at choice with a substantially downward movement or by a substantially horizontal shifting movement in said female coupling part, wherein in a coupled condition of said short side coupling parts the respective edges are locked to each other at least in a horizontal direction perpendicular to the respective edges and in the plane of the floor elements;

said short side coupling parts being free from locking means effecting in said coupled condition a locking in a vertical direction perpendicular to the plane of coupled floor elements, and said male coupling part including a distal face extending essentially downwardly and inwardly.

18. The floor element of claim 17, wherein said short side coupling parts in said coupled condition comprise interacting horizontally active locking surfaces extending at an angle of about 70 degrees or more with said plane of coupled panels.

19. The floor element of claim 17, wherein said female coupling part comprises a resiliently bendable portion.

20. The floor element of claim 17, wherein said short side coupling parts in said coupled condition comprise interacting vertically active support surfaces extending generally parallel to said plane of coupled panels.

21. The floor element of claim 17, wherein said floor elements have a width of about 16 centimeters or less.

22. The floor element of claim 17, wherein said long side coupling parts in said coupled condition allow for a shifting alongside the respective coupled edges.

* * * * *